US008628000B2

(12) United States Patent
Spivey, Sr. et al.

(10) Patent No.: US 8,628,000 B2
(45) Date of Patent: Jan. 14, 2014

(54) CARTON WITH INTERLOCKING DIVIDER

(75) Inventors: Raymond R. Spivey, Sr., Mableton, GA (US); Jean-Manuel Gomes, Marietta, GA (US); Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 34 days.

(21) Appl. No.: 13/345,780

(22) Filed: Jan. 9, 2012

(65) Prior Publication Data

US 2012/0104082 A1 May 3, 2012

Related U.S. Application Data

(62) Division of application No. 12/753,445, filed on Apr. 2, 2010, now Pat. No. 8,127,980, which is a division of application No. 11/351,554, filed on Feb. 10, 2006, now Pat. No. 7,717,321.

(60) Provisional application No. 60/652,138, filed on Feb. 11, 2005, provisional application No. 60/657,148, filed on Feb. 28, 2005.

(51) Int. Cl.
*B65D 25/04* (2006.01)
*B31B 11/00* (2006.01)

(52) U.S. Cl.
USPC ..... 229/120.24; 206/427; 229/120.26; 229/120.28; 229/120.32; 493/90; 493/92

(58) Field of Classification Search
USPC ..... 229/120.11, 120.18, 120.21, 120.24, 229/120.26, 120.28, 120.29, 120.32; 206/427; 493/90, 92, 128, 183, 912; 53/467
See application file for complete search history.

(56) References Cited

U.S. PATENT DOCUMENTS 1,120,752 A 12/1914 Smiley
1,896,326 A 2/1933 Northway-Ley (Continued)

FOREIGN PATENT DOCUMENTS

CH 263456 8/1949
DE 88 14 144.6 2/1989

(Continued)

OTHER PUBLICATIONS

International Search Report and Written Opinion dated Jun. 2, 2006 for application No. PCT/US2006/004661.

(Continued)

*Primary Examiner* — Gary Elkins
(74) *Attorney, Agent, or Firm* — Womble Carlyle Sandridge & Rice, LLP

(57) ABSTRACT

A package comprises a carton and a divider. The carton has a plurality of panels that extends at least partially around an interior of the carton and at least two end flaps respectively foldably attached to respective panels of the plurality of panels. The end flaps are overlapped with respect to one another and thereby at least partially form a closed end of the carton. The divider has a divider panel that at least partially divides the interior of the carton and a securing flap that is connected to the divider panel. The securing flap is positioned between the overlapping end flaps of the carton, whereby the divider is at least partially secured to the closed end of the carton.

16 Claims, 24 Drawing Sheets

(56) References Cited

U.S. PATENT DOCUMENTS

| | | | | |
|---|---|---|---|---|
| 1,898,646 | A | 2/1933 | Taylor | |
| 2,312,846 | A | 3/1943 | Olvey | |
| 2,475,107 | A | 7/1949 | Newsom | |
| 2,844,294 | A | 7/1958 | Williams | |
| 2,854,050 | A * | 9/1958 | Di Padova | 229/5.5 |
| 2,875,942 | A | 3/1959 | Wilson | |
| 3,822,785 | A | 7/1974 | Getz et al. | |
| 3,937,326 | A | 2/1976 | Schick | |
| 4,105,154 | A | 8/1978 | Meyers et al. | |
| 4,120,443 | A | 10/1978 | Gardner et al. | |
| 4,421,229 | A | 12/1983 | Pan et al. | |
| 4,577,799 | A | 3/1986 | Oliff | |
| 5,190,211 | A * | 3/1993 | Stoddard et al. | 229/120.21 |
| 5,234,102 | A | 8/1993 | Schuster et al. | |
| 5,246,113 | A | 9/1993 | Schuster | |
| 5,415,344 | A | 5/1995 | Harrelson | |
| 5,427,242 | A | 6/1995 | Oliff et al. | |
| 5,437,143 | A | 8/1995 | Culpepper et al. | |
| 5,518,111 | A | 5/1996 | Stout | |
| 5,620,094 | A | 4/1997 | Naumann | |
| 5,669,500 | A | 9/1997 | Sutherland | |
| 5,682,984 | A | 11/1997 | Hoell et al. | |
| 5,772,030 | A | 6/1998 | Baxter | |
| 5,826,783 | A | 10/1998 | Stout | |
| 5,826,870 | A | 10/1998 | Vulgamore et al. | |
| 5,848,686 | A | 12/1998 | Dean | |
| 5,868,252 | A | 2/1999 | Oliff | |
| 5,938,109 | A | 8/1999 | Sainz et al. | |
| 5,957,288 | A | 9/1999 | Campbell | |
| 5,967,406 | A | 10/1999 | Moorman | |
| 5,996,883 | A | 12/1999 | Bates | |
| 6,012,630 | A | 1/2000 | Block | |
| 6,112,977 | A | 9/2000 | Sutherland et al. | |
| 6,176,419 | B1 | 1/2001 | Holley, Jr. | |
| 6,991,107 | B2 | 1/2006 | Harrelson | |
| 7,093,713 | B2 | 8/2006 | Sutherland | |
| 7,195,118 | B2 | 3/2007 | Sutherland | |
| 7,475,778 | B2 | 1/2009 | Sutherland | |
| 7,717,321 | B2 | 5/2010 | Spivey, Sr. et al. | |
| 8,127,980 | B2 * | 3/2012 | Spivey et al. | 229/120.32 |
| 2004/0155098 | A1 * | 8/2004 | Harrelson | 229/120.32 |
| 2005/0115843 | A1 | 6/2005 | Harrelson | |
| 2005/0167292 | A1 | 8/2005 | Sutherland | |

FOREIGN PATENT DOCUMENTS

| | | |
|---|---|---|
| DE | 91 11 941.3 | 2/1992 |
| EP | 0 595 602 | 5/1994 |
| FR | 1427897 | 4/1966 |
| FR | 1489087 | 7/1967 |
| FR | 1497652 | 10/1967 |
| FR | 2223985 | 10/1974 |
| GB | 434145 | 8/1935 |
| GB | 2 198 709 | 6/1988 |
| GB | 2 323 352 | 9/1998 |
| JP | 62-062617 A | 4/1987 |
| JP | 5-7621 | 2/1993 |
| JP | 7-125745 | 5/1995 |
| JP | 9-142449 | 6/1997 |
| JP | 11-130049 | 5/1999 |
| JP | 2000-85754 | 3/2000 |
| JP | 2000-238779 | 9/2000 |
| JP | 2002-526346 A | 8/2002 |
| WO | WO 92/07772 | 5/1992 |
| WO | WO 96/29261 | 9/1996 |
| WO | WO 00/20288 | 4/2000 |
| WO | WO 02/30764 | 4/2002 |
| WO | WO 2004/014755 | 2/2004 |

OTHER PUBLICATIONS

Notification of Reason for Refusal issued May 12, 2010 for application No. JP 2007-555226, including English translation.
Notification of Reason for Refusal issued Oct. 1, 2010 for application No. JP 2007-555226, including English translation.
Office Action dated Dec. 4, 2008 for U.S. Appl. No. 11/351,554.
Response to Restriction Requirement dated Dec. 30, 2008 for U.S. Appl. No. 11/351,554.
Office Action dated Apr. 1, 2009 for U.S. Appl. No. 11/351,554.
Amendment A and Response to Office Action dated May 27, 2009 for U.S. Appl. No. 11/351,554.
Office Action dated Aug. 27, 2009 for U.S. Appl. No. 11/351,554.
Amendment B and Response to Office Action dated Oct. 27, 2009 for U.S. Appl. No. 11/351,554.
Office Action dated Dec. 30, 2010 for U.S. Appl. No. 12/753,445.
Response to Restriction Requirement dated Jan. 20, 2011 for U.S. Appl. No. 12/753,445.
Office Action dated May 11, 2011 for U.S. Appl. No. 12/753,445.
Amendment A and Response to Office Action dated Aug. 10, 2011 for U.S. Appl. No. 12/753,445.
Notice of Allowance and Fee(s) Due dated Nov. 14, 2011 for U.S. Appl. No. 12/753,445.

* cited by examiner

CARTON WITH INTERLOCKING DIVIDER

CROSS-REFERENCE TO RELATED APPLICATIONS

This application is a divisional of U.S. patent application Ser. No. 12/753,445, filed Apr. 2, 2010, which is a divisional of U.S. patent application Ser. No. 11/351,554, filed Feb. 10, 2006, which application claims the benefit of both U.S. Provisional Application Ser. No. 60/652,138, filed Feb. 11, 2005 and entitled "Tower Pack/Twin Stack Carton" and U.S. Provisional Application Ser. No. 60/657,148, filed Feb. 28, 2005 and entitled "Stacked Can Divider Pad".

INCORPORATION BY REFERENCE

The entire contents of U.S. patent application Ser. No. 12/753,445, filed Apr. 2, 2010, and U.S. patent application Ser. No. 11/351,554, filed Feb. 10, 2006, and U.S. Provisional Application No. 60/652,138, filed Feb. 11, 2005, and U.S. Provisional Application No. 60/657,148, filed Feb. 28, 2005 are hereby incorporated by reference as if presented herein in their entirety.

BACKGROUND OF THE INVENTION

The present invention generally relates to cartons for holding and dispensing cylindrical containers or other types of articles. More specifically, the present invention relates to cartons with a divider to separate at least two layers of articles and to keep the articles level and separated in stacks.

Fully enclosed cartons that are capable of carrying containers have been used in the past that have a feature for dispensing the containers one at a time. Many of these dispensers do not work in a satisfactory fashion when the containers are carried in two layers. The dividers on existing dual layer cartons typically do not readily permit the dispensing of cans from each layer in a carton that contains two layers of cans. A dual layer carton is needed having a divider that supports the containers such that the containers in one layer do not interfere with the dispensing of containers in the other layer. Further, a carton is needed having a divider that remains in place during the dispensing of all the containers in the carton.

SUMMARY OF THE INVENTION

The present invention generally relates to a carton in a tower pack/twin stack configuration. The present invention can be used, for example, with articles that contain products such as food and beverages. These articles can include canned food such as soup, cat food, or beverage containers such as cans, bottles, and PET containers, as well as other containers preferably being round in shape, such as those used in packaging food stuffs.

According to a first embodiment of the invention, a carton comprises a divider having a securing flap for interlocking engagement with side flaps and a bottom flap of the carton.

According to one aspect of the present invention, the divider keeps each level of containers separated and in a dispensable formation. The divider can be substantially secured in the carton without the use of glue or other adhesive to secure the divider to the carton. The divider is secured in the carton such that the divider typically remains substantially stationary during the removal of containers from the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION OF THE PREFERRED EMBODIMENTS

The present invention generally relates to cartons including packages including a carton housing a plurality of articles and a divider positioned between layers of the articles. The present invention can be used, for example, in cartons that contain articles or other products such as, for example, food and beverages or pet food. The articles can also include soup cans or other food or beverage containers such as, for example, cans, bottles, PET containers, or other containers such as those used in packaging foodstuffs. For the purposes of illustration and not for the purpose of limiting the scope of the present invention, the following detailed description describes generally cylindrical containers as disposed within the carton embodiments. In this specification, the relative terms "lower," "bottom," "upper" and "top" indicate relative orientations determined in relation to fully erected cartons.

Figure 1:
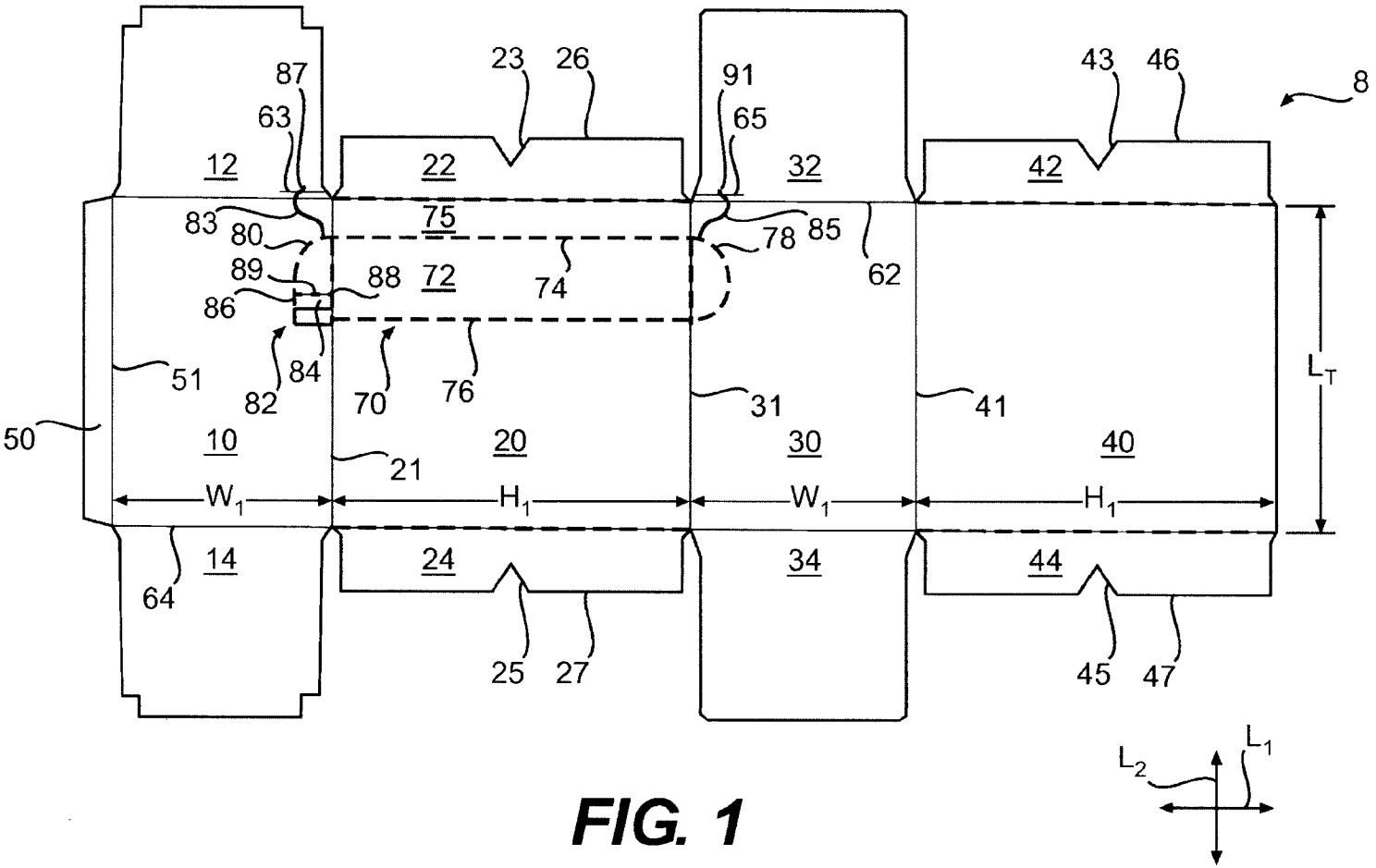
FIG. 1 is a plan view of a blank used to form a carton according to a first embodiment of the invention.
Figure 2:
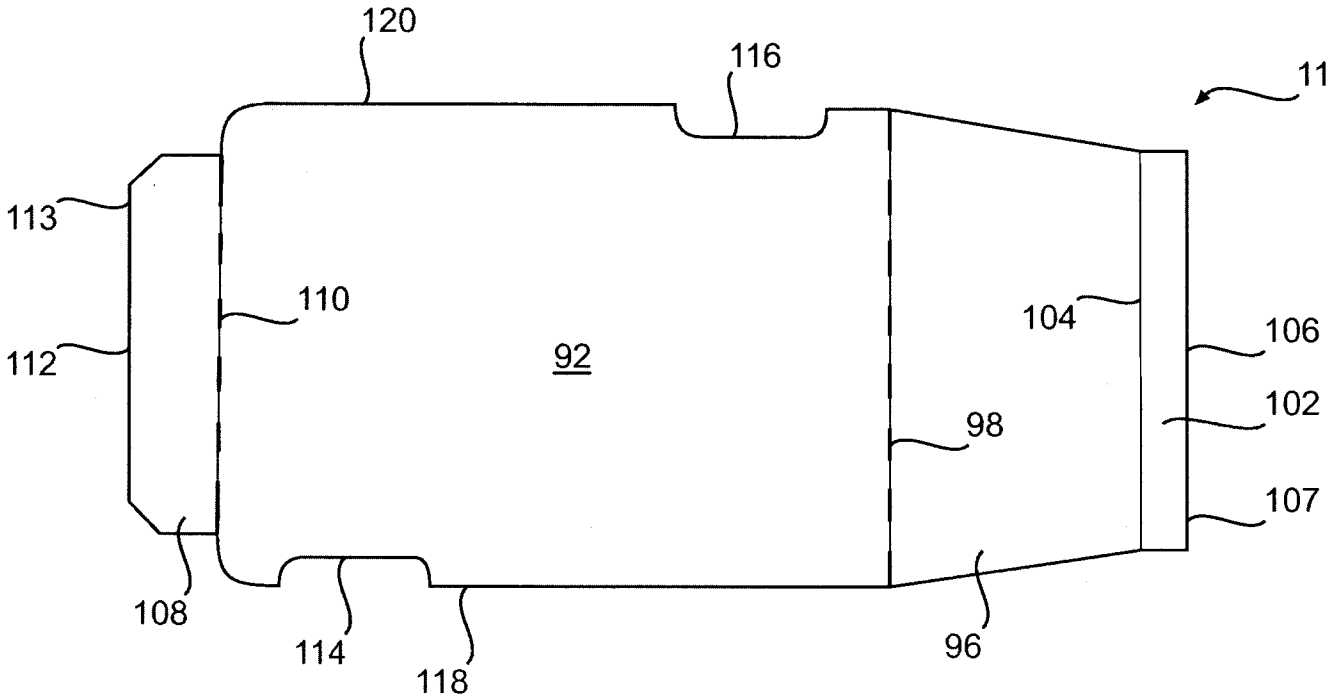
FIG. 2 is a plan view of a blank used to form a divider according to one embodiment of this invention.

FIG. 1 is a plan view of the interior side of a blank, generally indicated at 8, used to form a carton 150 (illustrated in FIGS. 3 and 9) according to a first embodiment of the invention. The carton 150 can be used to house a plurality of articles such as containers C (FIG. 3) typically arranged in at least two layers in the carton. The layers of containers C are separated by a divider, generally indicated at 90 (FIG. 3) formed from a blank, generally indicated 11 (FIG. 2). As will be discussed in more detail herein, the divider 90 is secured in the carton 150 so that the divider remains in a generally fixed position in the carton when the containers are removed from the carton. In the illustrated embodiment, the containers C are arranged in an upper layer and a lower layer with each of the upper and lower layers comprising six containers arranged in two rows, three containers per row. This arrangement is generally referred to as a 2×3×2 arrangement. It is understood that the containers C may be arranged in more than two layers and that each layer may have more or less than six containers without departing from the scope of this invention.

The blank 8 has a longitudinal axis L1 and a lateral axis L2. In the illustrated embodiment, the blank 8 comprises a bottom panel 10 foldably connected to a first side panel 20 at a first transverse fold line 21, a top panel 30 foldably connected to the first side panel 20 at a second transverse fold line 31, and a second side panel 40 foldably connected to the top panel 30 at a third transverse fold line 41. An adhesive flap 50 can be foldably connected to the bottom panel 10 at a fourth transverse fold line 51.

The bottom panel 10 is foldably connected to a first bottom end flap 12 and a second bottom end flap 14. The first side panel 20 is foldably connected to a first side flap 22 and a second side flap 24. The top panel 30 is foldably connected to a first top end flap 32 and a second top end flap 34. The second side panel 40 is foldably connected to a first side flap 42 and a second side flap 44. When the carton 150 is erected, the end flaps 12 and 32 and side flaps 22 and 42 close one end of the carton 150, and the end flaps 14 and 34 and side flaps 24 and 44 close a second end of the carton 150. In accordance with an alternative embodiment of the present invention, different flap arrangements can be used for closing the ends of the carton.

The end flaps 12 and 32 and side flap 22 and 42 may extend along a first marginal area of the blank 8, and may be foldably connected at a first longitudinal fold line 62 that extends along the length of the blank 8. The end flaps 14 and 34 and side flaps 24 and 44 may extend along a second marginal area of the blank 8, and may be foldably connected at a second longitudinal fold line 64 that also extends along the length of the blank 8. The longitudinal fold lines 62, 64 may be, for example, substantially straight, or offset at one or more locations to account for blank thickness or for other factors. In the illustrated embodiment side flaps 22, 24, 42, and 44 each have a corresponding notch 23, 25, 43, and 45 in a respective lateral edge 26, 27, 46, 47 of the flap. The lateral edge 26, 27, 46, 47 of each flap 22, 24, 42, and 44 is spaced apart from the corresponding fold line 62, 64 that attaches each flap to a respective panel 20, 40. In the illustrated embodiment, each notch 23, 25, 43, 45 is generally V-shaped and is located generally on the longitudinal centerline of each flap 22, 24, 42, 44, midway between opposite ends of each flap, although differently shaped and positioned notches are also within the scope of the present invention.

The carton blank 8 may include a dispenser, generally indicated 70, that includes a dispenser panel 72 removably attached to the side panel 20. The dispenser panel 72 is attached to the carton blank 8 at a first tear line 74 extending longitudinally in the side panel 20 and a second tear line 76 generally parallel to the first tear line. The tear lines 74 and 76 are spaced apart a predetermined distance to form an opening 93 (FIG. 9) in the side panel 20 that is sized to allows the selective removal of articles from the carton 150 when the dispenser panel 72 is removed. In the illustrated embodiment, the first tear line 74 and second tear line 76 are connected by a third tear 78 in the top panel 30 that is curved to correspond to the shape of the containers C in the carton 150. In the illustrated embodiment, the dispenser 70 has a fourth tear line 80 in the bottom panel 10 that is arcuate and extends from the first tear line 74 into the bottom panel. An access cutout 82 is located directly above an access flap 84. The access flap 84 is defined by first and second cut lines 86, 88 and is foldable at a fold line 89. The tear lines 74, 76, 78, 80 and the access cutout 82 define the dispenser panel 72 of the dispenser 70. In the illustrated embodiment, the dispenser panel 72 extends across the longitudinal length of the first side panel 20 into a portion of the top panel 30 and a portion of the bottom panel 10. The cuts forming the dispenser 70 may extend, for example, through the entire thickness of the blank 8.

The dispenser 70 also includes first and second arcuate base tear lines 83, 85 and first and second pivot cut lines 87, 91. The first base tear line 83 extends from the fourth tear line 80 to the fold line 62 and the second base tear line 85 extends from the third tear line 78 to the fold line 62. The first pivot cut line 87 extends from the fold line 62, at a point adjacent to the first base tear line 83, through a pivot fold line 63 in the first bottom flap 12. The second pivot cut line 91 extends from the fold line 62, at a point adjacent to the second base tear line 85, through a pivot fold line 65 into the first top end flap 32. The base tear lines 83, 85 and the pivot cut lines 87, 91 define a pivotable flap 75 of the dispenser 70.

The dispenser panel 72 may be removed from the carton 150 to form the opening 93 by grasping the access flap 84 and tearing the carton at the tear lines 74, 76, 78, and 80 and removing the panel from the carton. The opening 93 is sized to allow the containers C to be grasped and removed from the carton 150 as desired by the user. It is understood that the dispenser 70 of the illustrated embodiment may be further opened by pivoting the flap 75 outward by separating the flap at the first and second base tear lines 83, 85. The flap 75 pivots about the first and second pivot cut lines 87, 91 to effectively widen the opening 93 of the dispenser and allows articles to be more easily removed from the carton. It is understood that the carton 150 may have more than one dispenser 70 or that the dispenser may be omitted from the carton without departing from the scope of this invention. Further, the dispenser 72 may be otherwise sized and shaped to correspond with various other sizes and shapes of containers which may be housed in the carton 150. The first through fourth tear lines 74, 76, 78, 80 of the dispenser 70 can be continuous or substantially continuous tear lines formed by, for example, scores, creases, cuts, gaps, cut/creases, perforations, offset cuts, and combinations thereof. If cuts are used to form the dispenser pattern tear lines 74, 76, 78, 80, the cuts may be interrupted by, for example, one or more breachable nicks.

The dimensions and shape of the blank 8 may be selected to accommodate the characteristic dimensions of the containers C to be accommodated within the carton 150. For example, the top panel 30 and bottom panel 10 can have widths W1 that generally correspond to or slightly exceed a combined width W2 (FIG. 3) of the adjacent rows of containers C to be held within the carton 150. The first and second side panels 20, 40 can have, for example, heights H1 that generally correspond to or slightly exceed a combined height H2 (FIG. 3) of the layers of containers C. The bottom panel 10, top panel 30, and side panels 20 and 40 may have a length LT (FIG. 1) that generally corresponds to or slightly exceeds a combined length LC (FIG. 3) of the adjacent rows of containers C. It is understood that heights H1 may correspond to or slightly exceed an integral multiple of the height of each container C, the widths W2 may correspond to or slightly exceed an integral multiple of the width of each container, and the length LT may correspond to or slightly exceed an integral multiple of the length of each container C. For example, the widths W1 of the bottom panel 10 and top panel 30 are approximately twice the width of each container C, the heights H1 of the side panels 20, 30 are approximately twice the height of each container, and the length LT of the panels 10, 30, 20, and 40 is approximately three times the length of the container. The dimensions W1, H1, and LT of the illustrated embodiment correspond with a carton sized to accommodate a 2×3×2 stacked arrangement of the containers C. In the illustrated embodiment the containers C are cylindrical so that the width and length of each container corresponds with a diameter of the container. It is understood that the heights H1, widths W2, and lengths LT each may be greater or less than the dimensions shown and described herein depending on the arrangement and size of the containers C in the carton 150.

Figure 3:
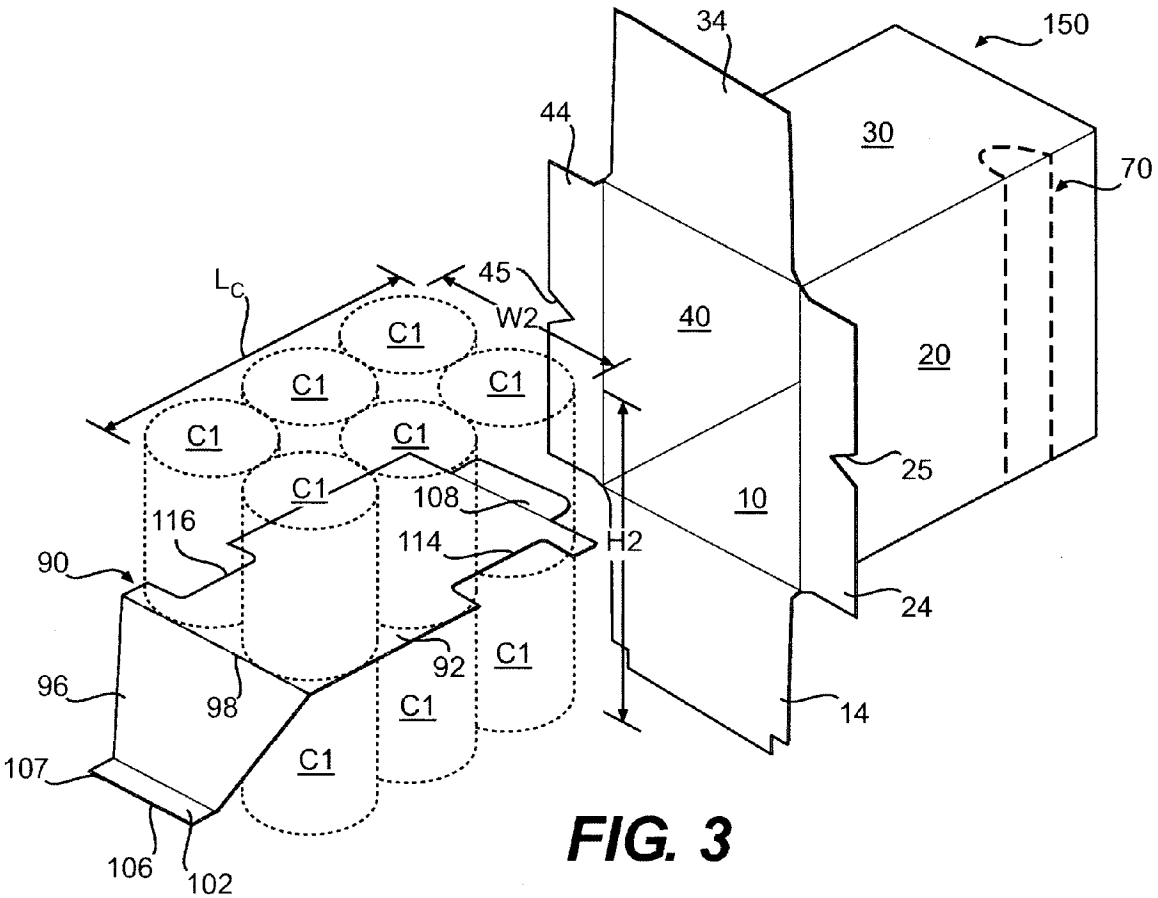
FIG. 3 is an exploded perspective of the carton formed from the blank of FIG. 1 with the divider formed from the blank of FIG. 2 placed between two layers of containers and removed from the carton.
Figure 9:
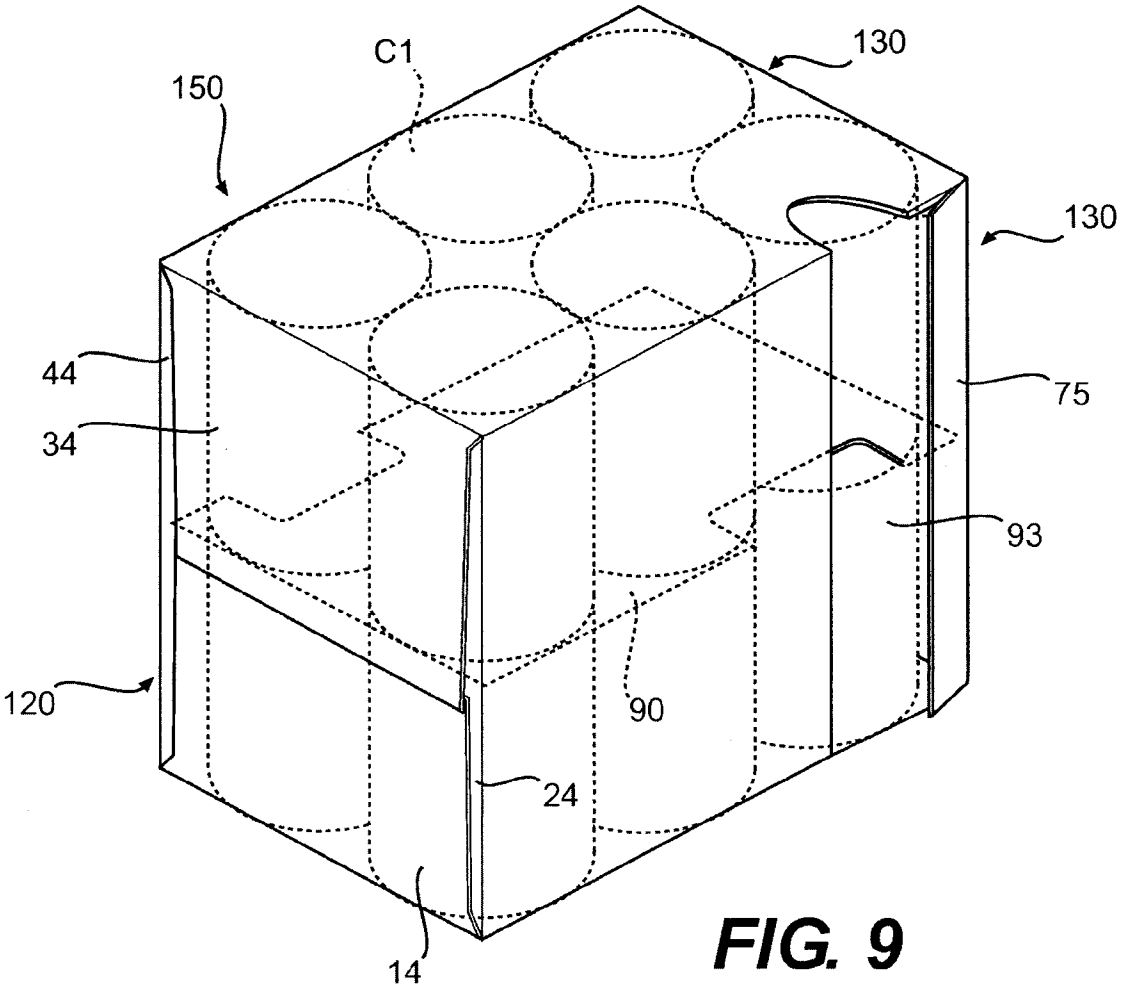
FIG. 9 is a perspective view of the carton with containers loaded and the first and second ends closed.

As shown in FIGS. 2 and 3, the blank 11 used to form the divider 90 of the illustrated embodiment has a divider panel 92 for positioning between the layers of containers C when the containers are loaded into the carton 150. The divider panel 92 may be sized to generally correspond with the size of the bottom panel 10 and top panel 30 of the carton blank 8. The blank 11 for the divider 90 includes a retention panel 96, foldably attached to the divider panel 92 along a lateral fold line 98 at a first end of the divider panel. In the illustrated embodiment, the retention panel 96 has a narrowing width across the length of the blank 11, and a first locking flap (broadly "first securing flap") 102 is foldably attached to the retention panel 96 along a lateral fold line 104. The first locking flap 102 has an outer edge 106 corresponding to a first longitudinal end 107 of the blank 11. In the illustrated embodiment, the blank 11 has a second locking flap (broadly "second securing flap") 108 foldably attached to the divider panel 92 along a lateral fold line 110. The second locking flap 108 has an outer edge 112 corresponding to a second longitudinal end 113 of the blank 11. In the illustrated embodiment, the divider panel 92 has two notches 114, 116 in a corresponding longitudinal edge margin 118, 120 of the blank 11. As shown in FIG. 9, the notches 114, 116 are positioned along the longitudinal length of the divider panel 92 so that at least one of the notches is aligned with the dispenser 70 of the carton 150. In the illustrated embodiment, the two notches 114, 116 are shown on opposite sides of the divider panel to accommodate the location of an additional dispenser (not shown) in the carton. The alignment of one of the notches 114, 116 with the dispenser 70 can help to facilitate removal of the containers C through the opening 93 in the dispenser 70.

The carton 150 may be erected from the blank 8 by first gluing or otherwise adhering the adhesive flap 50 (shown in FIG. 1) to the inner side of the side panel 40 so that the bottom panel 10, the first side panel 20, the top panel 30, and the second side panel 40 may be opened or set up to form a generally tubular sleeve. The generally tubular sleeve may be closed, for example, by folding and adhering the end flaps 12, 22, 32, 42 at one end of the carton to form a first end panel 120 (FIG. 9), and by folding and adhering the end flaps 14, 24, 34, 44 at the other end of the carton to form a second end panel 130 (FIG. 9). Containers C or other articles, for example, may be loaded into the sleeve at any time before one or both ends of the carton are closed by the end flaps 12, 22, 32, 42, 14, 24, 34, 44. Preferably the containers C are configured in a stacked arrangement (FIG. 3) with the divider 90 positioned between the two layers of containers prior to placing the containers in the carton 150.

FIG. 9 is a perspective view of the carton 150 erected from the blank 8 illustrated in FIG. 1. In the erected carton 150, the end flaps 12, 22, 32, 42 form the first end panel 120 and the end flaps 14, 24, 34, 44 form the second end panel 130. The divider 90 is secured to the carton 150 by interlocking engagement of the first locking flap 102 with the first end panel 120 and the interlocking engagement of the second locking flap 108 with the second end panel 130 of the carton 150. Loading of the carton 150 with containers C arranged in a stacked configuration will be discussed below with reference to FIGS. 3-9, and in accordance with one embodiment of the present invention.

Figure 4:
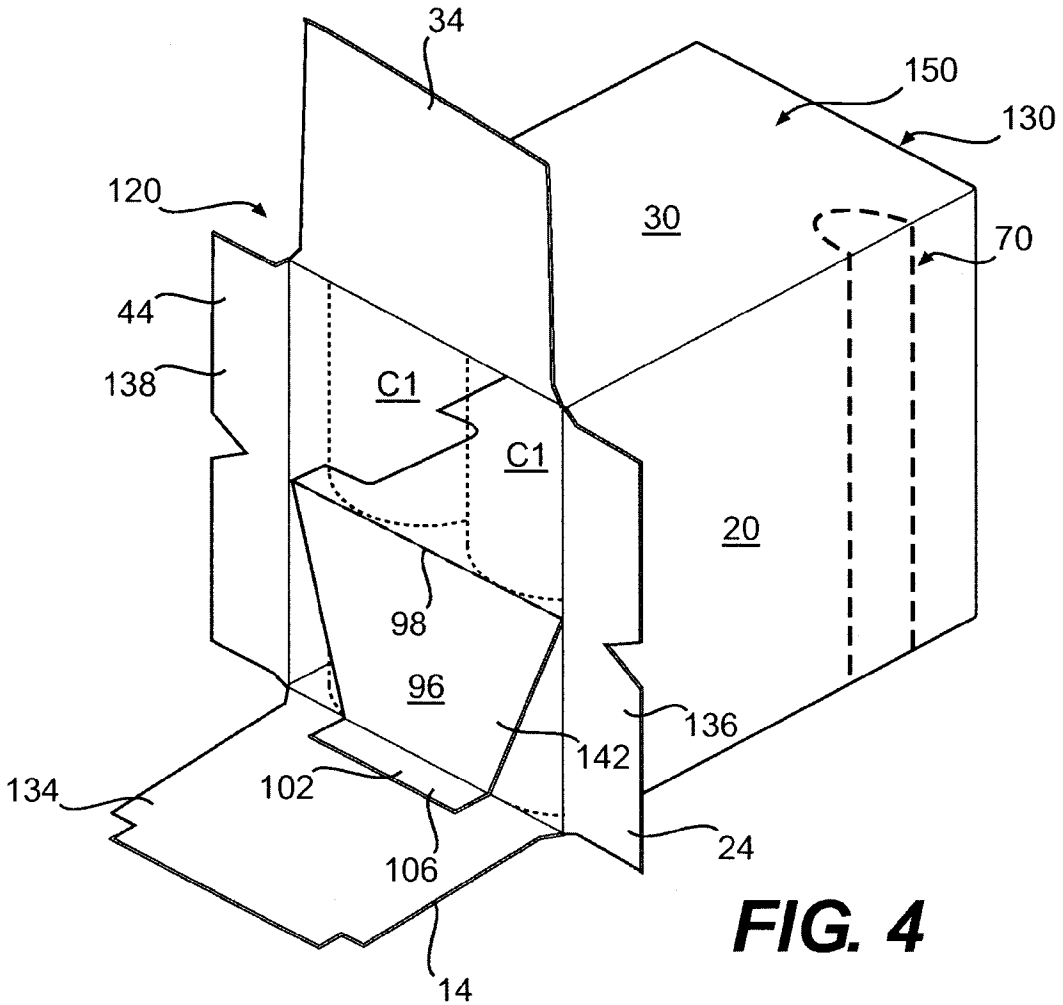
FIG. 4 is a perspective of a first end of the carton with the containers loaded into the carton.

As shown in FIGS. 3 and 4, the containers C may be arranged in a stacked configuration comprising an upper layer and a lower layer of containers C. In the illustrated embodiment, each layer comprises two rows of three containers C. The divider 90 is positioned between the upper and lower layers of containers C such that the divider panel 92 is positioned between the containers C and the retention panel 96 and first locking flap 102 extend from one end of the stacked containers and the second locking flap 108 extends from the other end of the stacked containers. The retention panel 96 is downwardly folded relative to the divider panel 92 along fold line 98 so that an inner surface of the retention panel 96 is generally adjacent the lower layer of containers C. As shown in FIG. 4, the locking flap 102 is folded along the fold line 104 and positioned at an oblique angle relative to the retention panel 96. After the containers C are arranged in the stacked configuration with the divider 90 positioned between the two layers, the stacked containers are loaded into the carton 150 (FIG. 4) such that the outer edge 106 of the locking flap 102 contacts an inner surface 134 of the end flap 14.

Figure 5:
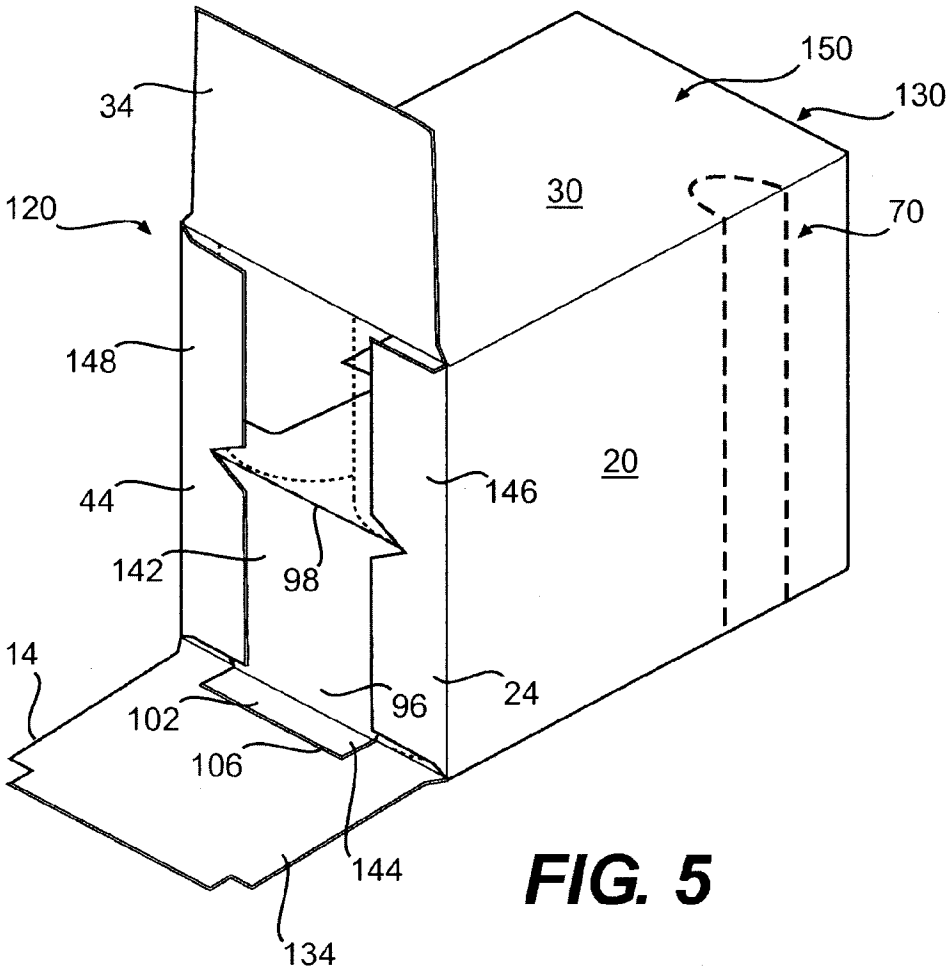
FIG. 5 is a view similar to FIG. 4 but showing side flaps of the carton closed.
Figure 6:
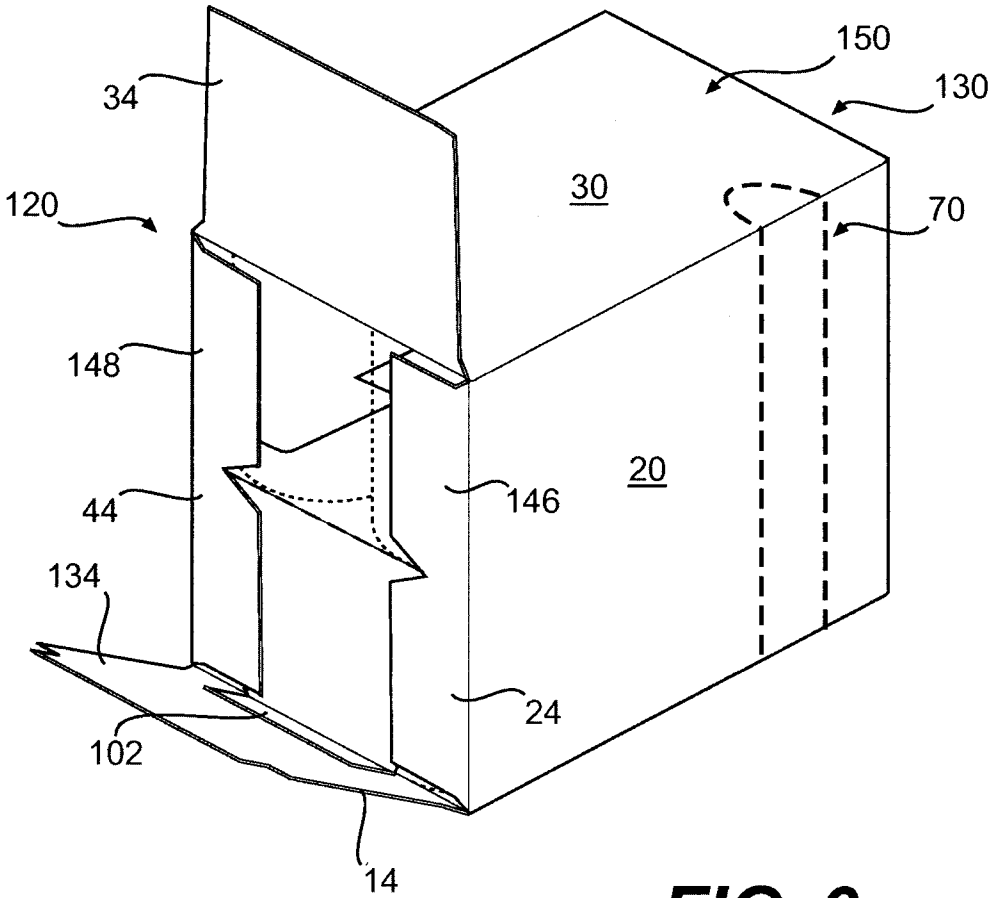
FIG. 6 is a view similar to FIG. 5 but showing a bottom flap of the carton partially closed.

After the stacked containers are loaded, the side flaps 24, 44 are moved to the closed position shown in FIG. 5 such that an inner surface 136, 138 of each of the flaps is in face-to-face relation with an outer surface 142 of the retention panel 96 and the locking flap 102 protrudes outward from beneath the bottom edges of the closed side flaps. As shown in FIG. 6 the end flap 14 is raised to the closed position and is positioned such that the inner surface 134 of the end flap 14 is in generally face-to-face relation with an outer surface of the locking flap 102. With the bottom end flap 14 raised to the closed position, the locking flap 102 is folded and lodged between the side flaps 24, 44 and the bottom end flap 14 so that the divider 90 is secured to the carton 150. In the closed position of the bottom end flap 14, an inner surface 144 of the locking flap 102 is in face-to-face relation with an outer surface 146, 148 of each of the side flaps 24, 44. The top end flap 34 is closed to complete the closure of the first end panel 120 of the carton 150. The top end flap 34 can be secured to the bottom end flap 14 with an adhesive material such as glue.

Figure 7:
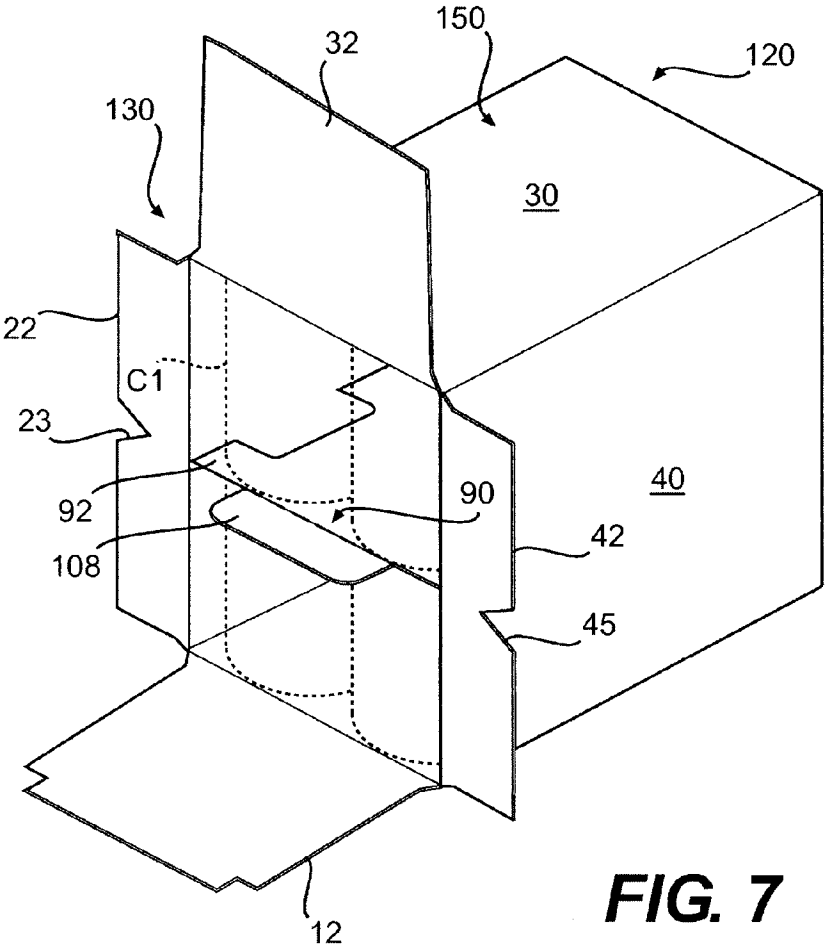
FIG. 7 is a perspective of a second end of the carton with containers loaded into the carton.
Figure 7A:
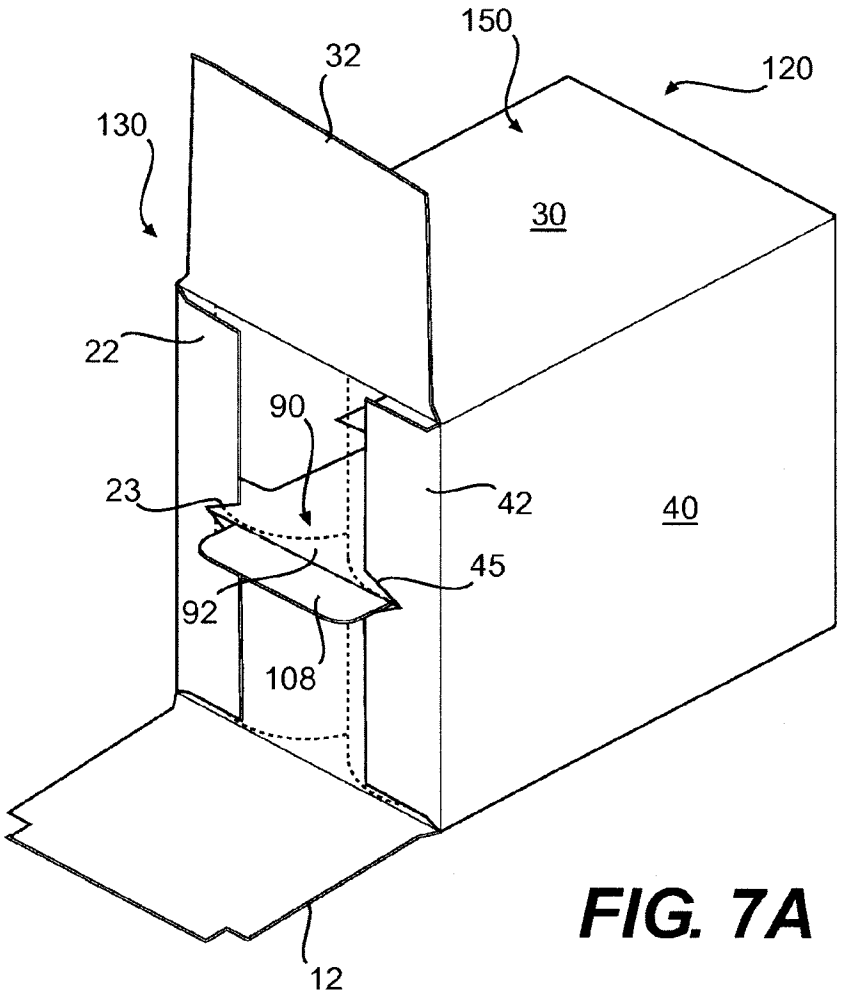
FIG. 7A is a perspective similar to FIG. 7 but showing side flaps of the carton closed.
Figure 8:
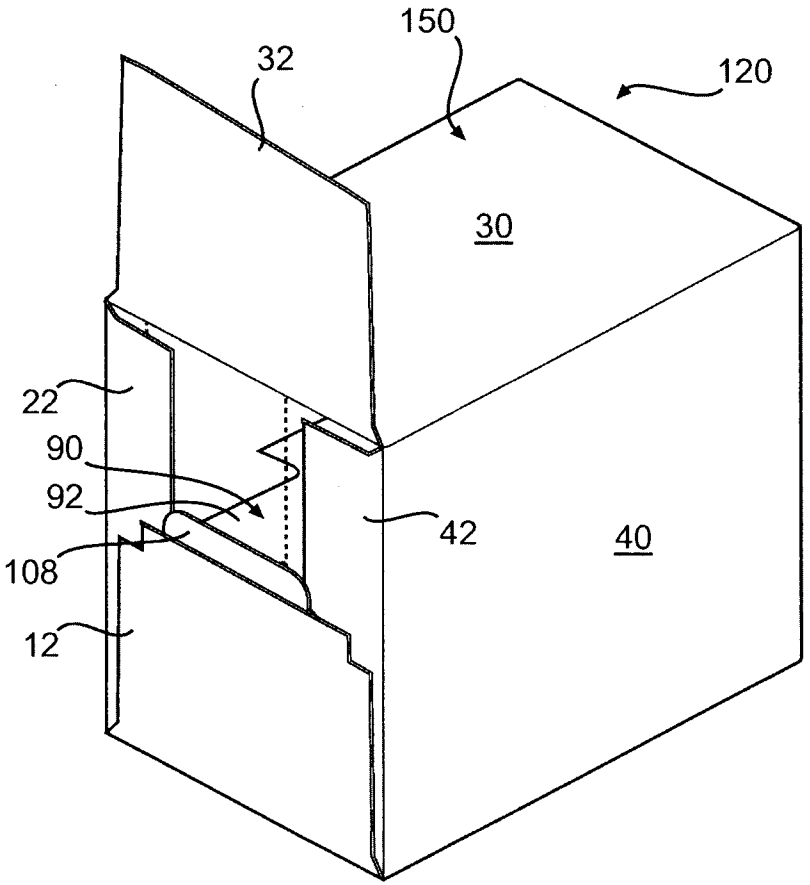
FIG. 8 is a perspective similar to FIG. 7A but showing a bottom flap of the carton closed.
Figure 8A:
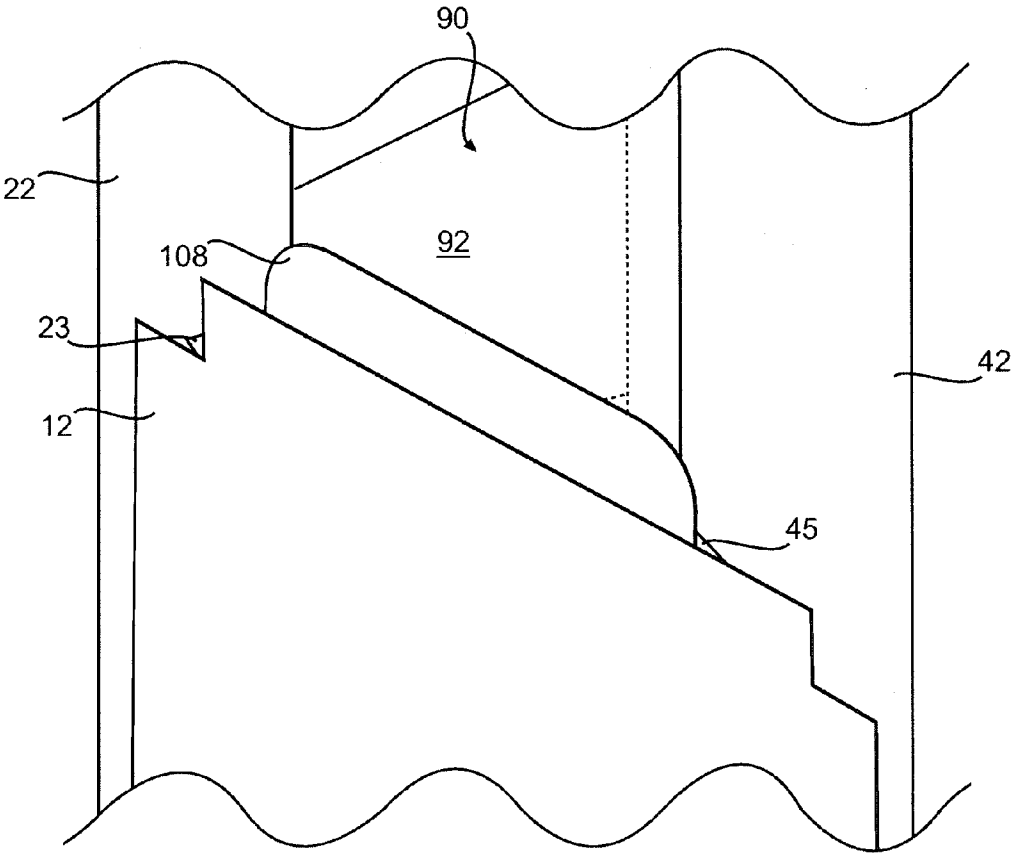
FIG. 8A is an enlarged portion of FIG. 8.

FIG. 7 shows the second end panel 130 of the carton 150 with the stacked containers loaded in the carton and the second locking flap 108 extending from the divider panel 92 in an unfolded position generally coplanar with the divider panel. As shown in FIG. 7A, the second end panel 130 of the carton 150 is closed by first folding the side flaps 22, 42 such that the second locking flap 108 is received in the notches 23, 45 in a respective side panel. As shown in FIGS. 8 and 8A, the bottom end flap 12 is folded upward relative to the bottom panel 10 such that the inner surface of the bottom end flap contacts the second locking panel 108 and folds the second locking panel upward relative to the divider panel 92 of the divider 90. In this way, the second locking panel 108 is folded upwardly along fold line 104 such that the second locking panel is lodged between the side flaps 22, 42 and the bottom end flap 12 so that the divider 90 is in interlocking engagement at the second end panel 130 of the carton 150. The top end flap 32 is folded downward to complete the closure of the second end panel 130 of the carton 150. The top end flap 32 can be secured to the bottom end flap 12 with an adhesive material such as glue.

In the assembled configuration shown in FIG. 9, containers C may be withdrawn from the upper level or the lower level of the stacked configuration housed in the carton 150 through the dispenser opening 93. A container or containers C adjacent to the dispenser opening 93 can be easily accessed and removed from the carton 150. The divider 90 is secured at both ends 130, 120 of the carton 150 so that when the containers C are removed, the divider remains substantially stationary in the carton and the containers remains arranged in a stacked configuration wherein the containers may be easily dispensed from the carton. The securement of the divider 90 in the carton 150 of the illustrated embodiment of the present invention is accomplished by the interlocking engagement of the first locking flap 102 with the side flaps 24, 44 and end flap 14 at the first end panel 120 of the carton, and the interlocking engagement of the second locking flap 108 with the side flaps 22, 42 and end flap 12 at the second end panel 130 of the carton. In this way, the divider 90 is secured to the carton 150 without the use of glue or other adhesive and is positioned to divide an interior space of the carton into an upper chamber and a lower chamber.

For purposes of illustration, the present invention is generally disclosed in the context of paperboard cartons or packages sized and dimensioned to contain cylindrical containers. The cartons illustrated in the drawing figures are sized to accommodate containers in a two level configuration with multiple columns of containers included in each level, although the present invention is not limited to any specific size or dimension. For example, the illustrated embodiment of FIGS. 1-9 is shown to accommodate twelve containers arranged in a 2×3×2 configuration, however, the present invention would work satisfactorily if sized and shaped to hold other quantities of containers in alternative arrangements, such as 3×4×2, 2×4×2, 2×5×2, 4×6×2, 4×5×2, 3×6×2, 5×6×2, etc. Further, multiple dividers could be used such that more than two layers of containers could be housed in the carton without departing from the scope of this invention.

Figure 10:
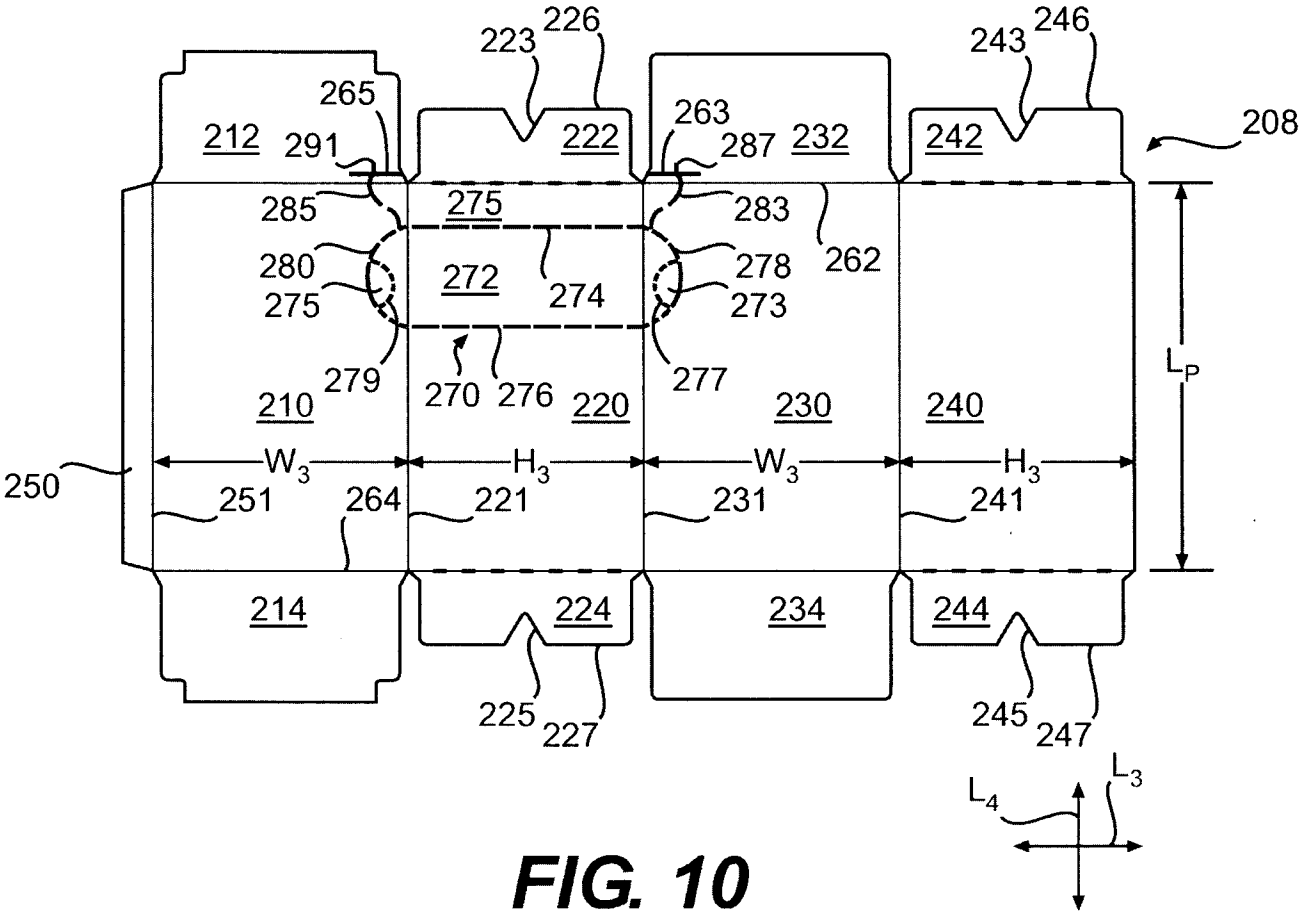
FIG. 10 is a plan view of a blank used to form a carton according to a second embodiment of the invention.
Figure 11:
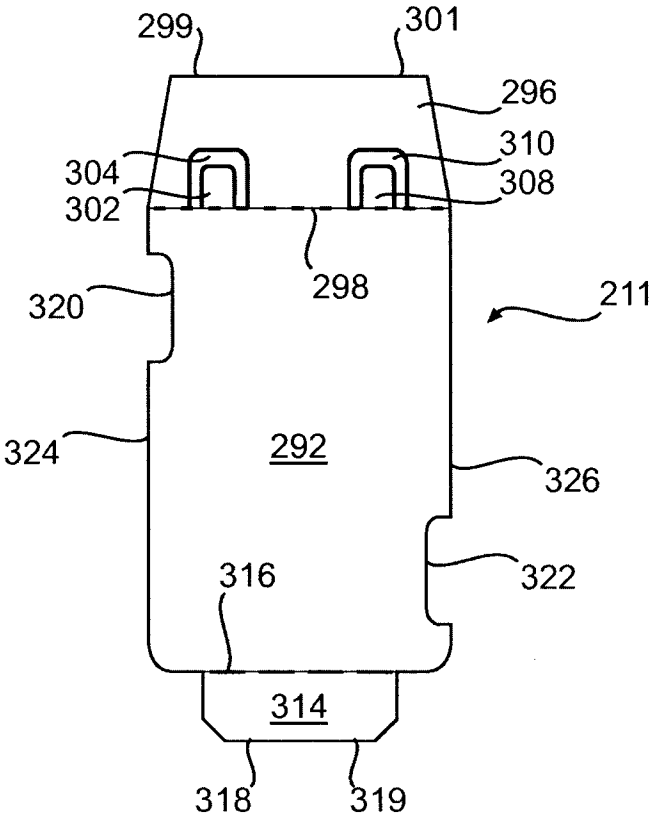
FIG. 11 is a plan view of a blank used to form a divider according to a second embodiment of this invention.

FIG. 10 is a plan view of the interior side of a blank, generally indicated at 208, used to form a carton 250 (illustrated in FIGS. 12 and 18) according to a second embodiment of the invention. The carton 250 can be used to house a plurality of articles such as containers C2 (FIG. 12) typically arranged in at least two layers in the carton. The layers of containers C2 are separated by a divider, generally indicated at 290 (FIG. 3) formed from a blank, generally indicated 211 (FIG. 2). As will be discussed in more detail herein, the divider 290 is secured in the carton 250 so that the divider remains in a generally fixed position in the carton when the containers are removed from the carton. In the illustrated embodiment, the containers C2 are generally cylindrical and of a relatively small height in comparison to the diameter of the containers. The relatively small height-to-diameter ratio of the containers C2 and the design of the containers allow the containers be nested into one another in stacks such that each layer of containers C2 includes two containers in a stacked arrangement. Thus, as shown in the FIG. 12, the bottom layer of containers C2 and top layer of container may each include a plurality of stacked containers arranged in columns and rows. In the embodiment of FIG. 3, the containers C2 are arranged in an upper layer and a lower layer with each of the upper and lower layers comprising twelve containers arranged in two columns and three rows. This arrangement is generally referred to as a 2×3×4 arrangement. It is understood that the containers C2 may be arranged in more than two layers and that each layer may have more or less than twelve containers without departing from the scope of this invention.

The blank 208 has a longitudinal axis L3 and a lateral axis L4. In the illustrated embodiment, the blank 208 comprises a bottom panel 210 foldably connected to a first side panel 220 at a first transverse fold line 221, a top panel 230 foldably connected to the first side panel 220 at a second transverse fold line 231, and a second side panel 240 foldably connected to the top panel 230 at a third transverse fold line 241. An adhesive flap 250 can be foldably connected to the bottom panel 210 at a fourth transverse fold line 251.

The bottom panel 210 is foldably connected to a first bottom end flap 212 and a second bottom end flap 214. The first side panel 220 is foldably connected to a first side flap 222 and a second side flap 224. The top panel 230 is foldably connected to a first top end flap 232 and a second top end flap 234. The second side panel 240 is foldably connected to a first side flap 242 and a second side flap 244. When the carton 250 is erected, the end flaps 212 and 232 and side flaps 222 and 242 close one end of the carton 250, and the end flaps 214 and 234 and side flaps 224 and 244 close a second end of the carton 250. In accordance with an alternative embodiment of the present invention, different flap arrangements can be used for closing the ends of the carton.

The end flaps 212 and 232 and side flap 222 and 242 may extend along a first marginal area of the blank 208, and may be foldably connected at a first longitudinal fold line 262 that extends along the length of the blank 208. The end flaps 214 and 234 and side flaps 24 and 44 may extend along a second marginal area of the blank 208, and may be foldably connected at a second longitudinal fold line 264 that also extends along the length of the blank 208. The longitudinal fold lines 262, 264 may be, for example, substantially straight, or offset at one or more locations to account for blank thickness or for other factors. In the illustrated embodiment side flaps 222, 224, 242, and 244 each have a corresponding notch 223, 225, 243, and 245 in a respective lateral edge 226, 227, 246, 247 of the flap. The lateral edge 226, 227, 246, 247 of each flap 222, 224, 242, and 244 is spaced apart from the corresponding fold line 262, 264 that attaches each flap to a respective side panel 220, 240. In the illustrated embodiment, each notch 223, 225, 243, 245 is generally V-shaped and is located generally on the longitudinal centerline of each flap 222, 224, 242, 244, midway between opposite ends of each flap, although differently shaped and positioned notches are also within the scope of the present invention.

The carton blank 208 may include a dispenser, generally indicated 270, that includes a dispenser panel 272 removably attached to the side panel 220. The dispenser panel 272 is attached to the carton blank 208 at a first tear line 274 extending longitudinally in the side panel 220 and a second tear line 276 generally parallel to the first tear line. The tear lines 274 and 276 are spaced apart a predetermined distance to form an opening 293 (FIG. 19) in the side panel 220 that is sized to allow the selective removal of articles from the carton 250 when the dispenser panel 272 is removed. In the illustrated embodiment, the dispenser includes a third tear line 278 in the top panel 230 and a fourth tear line 280 in the bottom panel 210 that are each curved to correspond to the shape of the containers C2. In the illustrated embodiment, the dispenser 270 includes a first finger panel 273 in the top panel 230 and a second finger panel 275 in the bottom panel 210. The first and second finger panels 273, 275 are formed by a respective curved tear line 277, 279 curved inwardly from a respective third and fourth tear line 278, 280. The finger panels 273, 275 include the respective portion of the top or bottom panel 210, 230 between the curved tear line 277, 279 and a portion of the tear line 278, 280 between the intersection of the respective ends of the curved tear lines with the third and fourth tear line. The tear lines 274, 276, 278, 280 and finger panels 273, 275 define the dispenser panel 272 of the dispenser 270. In the illustrated embodiment, the dispenser panel 272 extends across the longitudinal length of the first side panel 220 into a portion of the top panel 230 and a portion of the bottom panel 210. The cuts forming the dispenser 270 may extend, for example, through the entire thickness of the blank 208.

The dispenser 270 also includes first and second arcuate base tear lines 283, 285 and first and second pivot cut lines 287, 291. The first base tear line 283 extends from the third tear line 278 to the fold line 262 and the second base tear line 285 extends from the fourth tear line 280 to the fold line 262. The first pivot cut line 287 extends from the fold line 262, at a point adjacent to the first base tear line 283, through a pivot fold line 263 in the first top end flap 232. The second pivot cut line 291 extends from the fold line 262, at a point adjacent to the second base tear line 285, through a pivot fold line 265 into the first bottom flap 212. The base tear lines 283, 285 and the pivot cut lines 287, 291 define a pivotable flap 275 of the dispenser 270.

The dispenser panel 272 may be removed from the carton 250 to form the opening 293 by tearing the finger panels 273, 275 along the curved tear lines 277, 279 and grasping the dispenser panel and tearing the carton at the tear lines 274, 276, 278, and 280 and removing the panel from the carton. The opening 293 is sized to allow the containers C2 to be grasped and removed from the carton 250 as desired by the user. It is understood that the dispenser 270 of the illustrated embodiment may be further opened by pivoting the flap 275 outward by separating the flap at the first and second base tear lines 283, 285. The flap 275 pivots generally about the first and second pivot cut lines 287, 291 to effectively widen the opening 293 of the dispenser and allows articles to be more easily removed from the carton. It is understood that the carton 250 may have more than one dispenser 270 or that the dispenser may be omitted from the carton without departing from the scope of this invention. Further, the dispenser 272 may be otherwise sized and shaped to correspond with various other sizes and shapes of containers which may be housed in the carton 250. The first through fourth tear lines 274, 276, 278, 280 and the curved tear lines 277, 279 of the dispenser 270 can be continuous or substantially continuous tear lines formed by, for example, scores, creases, cuts, gaps, cut/creases, perforations, offset cuts, and combinations thereof. If cuts are used to form the dispenser pattern tear lines 274, 276, 278, 280, the cuts may be interrupted by, for example, one or more breakable nicks or may be continuous over a length of the tear line.

The dimensions and shape of the blank 208 may be selected to accommodate the characteristic dimensions of the containers C2 to be accommodated within the carton 250. For example, the top panel 230 and bottom panel 210 can have widths W3 (FIG. 10) that generally correspond to or slightly exceed a combined width W4 (FIG. 12) of the adjacent rows of containers C2 to be held within the carton 250. The first and second side panels 220, 240 can have, for example, heights H3 (FIG. 10) that generally correspond to or slightly exceed a combined height H4 (FIG. 12) of the layers of containers C2. The bottom panel 210, top panel 230, and side panels 220 and 240 may have a length LP (FIG. 10) that generally corresponds to or slightly exceeds a combined length LR (FIG. 12) of the adjacent rows of containers C2. It is understood that heights H3 may correspond to or slightly exceed an integral multiple of the height of each container C2, the widths W4 may correspond to or slightly exceed an integral multiple of the width of each container, and the length LP may correspond to or slightly exceed an integral multiple of the length of each container C2. For example, the widths W3 of the bottom panel 210 and top panel 230 are approximately twice the width of each container C2, the heights H3 of the side panels 220, 230 are approximately four times the height of each container, and the length LP of the panels 210, 230, 220, and 240 is approximately three times the length of the containers. The dimensions W3, H3, and LP of the illustrated embodiment correspond with a carton sized to accommodate a 2×3×4 stacked arrangement of the containers C2. In the illustrated embodiment the containers C2 are cylindrical so that the width and length of each container corresponds with a diameter of the container. It is understood that the heights H3, widths W3, and lengths LP each may be greater or less than the dimensions shown and described herein depending on the arrangement and size of the containers C2 in the carton 250.

Figure 12:
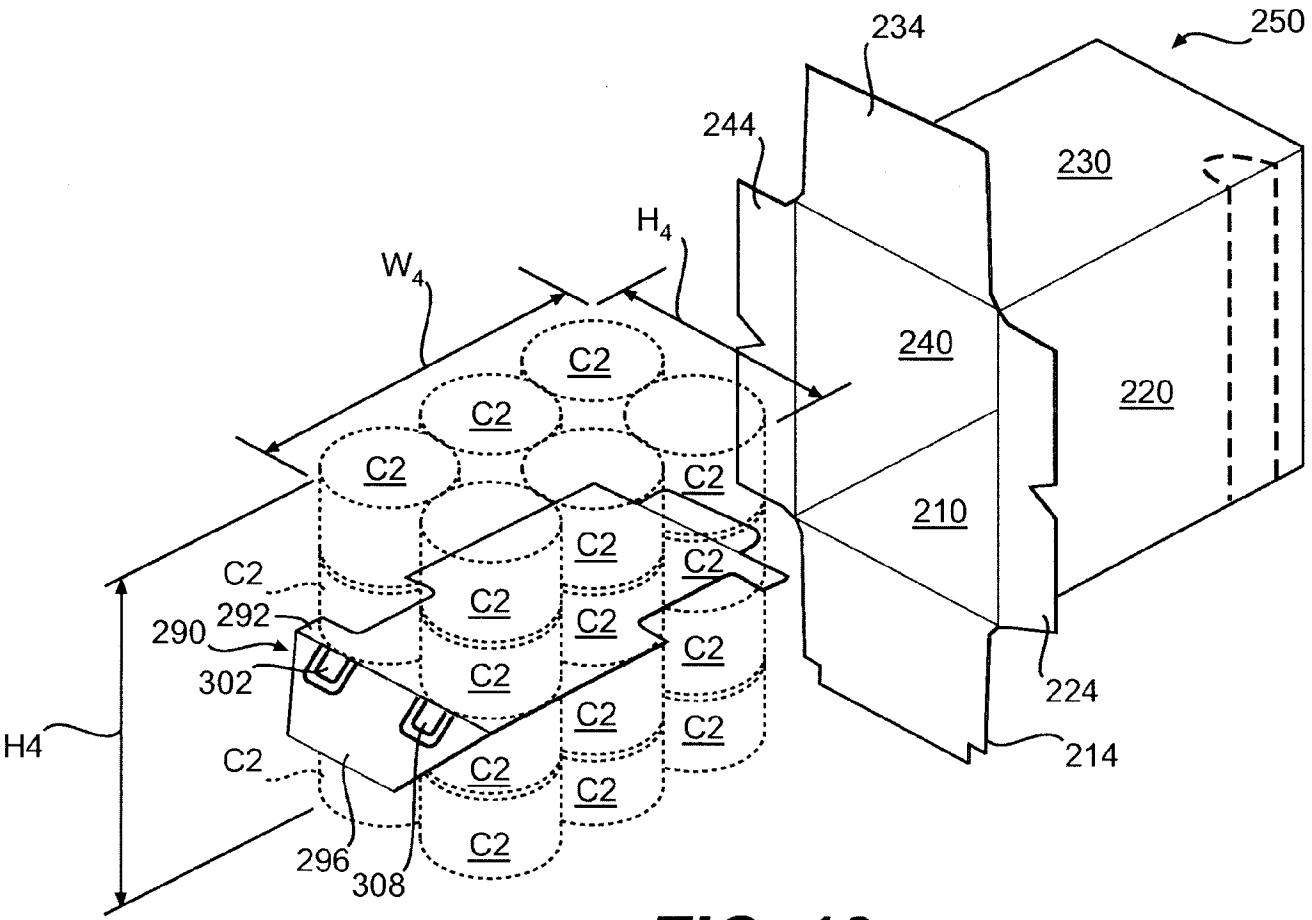
FIG. 12 is an exploded perspective of the carton formed from the blank of FIG. 10 with the divider formed from the blank of FIG. 11 placed between two layers of containers and removed from the carton.

As shown in FIGS. 10 and 12, the blank 211 used to form the divider 290 of the illustrated embodiment has a divider panel 292 for positioning between the layers of containers C2 when the containers are loaded into the carton 250. The divider panel 292 may be sized to generally correspond with the size of the bottom panel 210 and top panel 230 of the carton blank 208. The blank 211 for the divider 290 includes a retention panel 296, foldably attached to the divider panel 292 along a lateral fold line 298 at a first end of the divider panel. In the illustrated embodiment, the retention panel 296 has a narrowing width across the length of the blank 211 and an outer edge 299 including a first longitudinal end 301 of the blank. A first securing tab (broadly "first securing flap") 302 is foldably attached to the divider panel 292 along the fold line 298 and is spaced apart from the retention panel 296 by a cutout 304. In the illustrated embodiment, the blank 211 includes a second securing tab (broadly "second securing flap") 308 foldably attached to the divider panel 292 along the fold line 298 and spaced apart from the retention panel by a cutout 310. In the illustrated embodiment, the securing tabs 302, 308 are generally rectangular tabs laterally spaced along the longitudinal edge of the divider panel 392. It will be understood that the securing tabs 302, 308 could be other shapes and sizes than shown and that more or less than two securing tabs may be connected to the divider panel 292 without departing from the scope of this invention. Further, the cutouts 304, 310 can be in different forms; for example, they can be replaced with slits.

Figure 18:
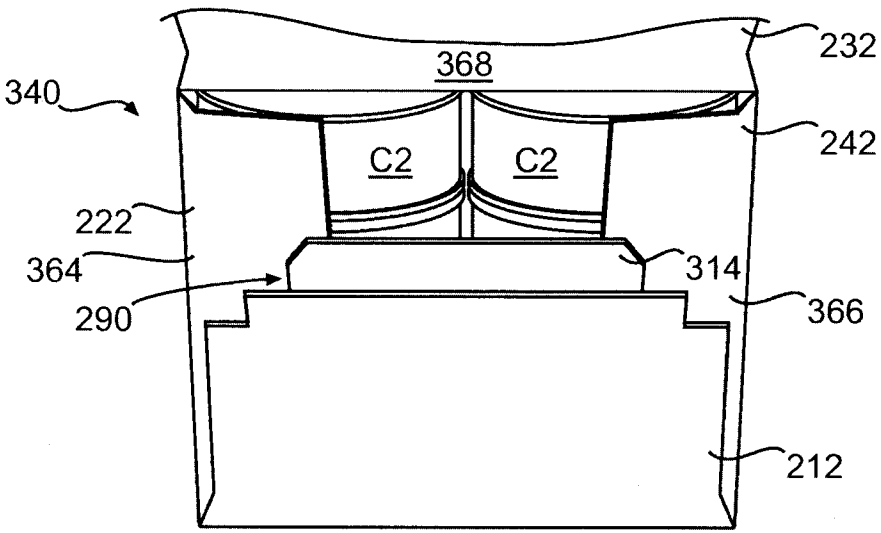
FIG. 18 is a perspective similar to FIG. 17 but showing a bottom flap of the carton closed.

In the illustrated embodiment, the blank 211 has a third securing flap 314 foldably attached to the divider panel 292 along a lateral fold line 316. The third securing flap 314 has an outer edge 318 including a second longitudinal end 319 of the blank 211. In the illustrated embodiment, the divider panel 292 has two notches 320, 322 in a corresponding longitudinal edge 324, 326 of the blank 11. As shown in FIG. 18, the notches 320, 322 are positioned along the longitudinal length of the divider panel 292 so that at least one of the notches is aligned with the dispenser 270 of the carton 250. In the illustrated embodiment, the two notches 320, 322 are shown on opposite sides of the divider panel 292 to accommodate the location of an additional dispenser (not shown) in the carton. The alignment of one of the notches 220, 222 with the dispenser 270 can help to facilitate removal of the containers C2 through the opening 293 in the dispenser.

The carton 250 may be erected from the blank 208 by first gluing or otherwise adhering the adhesive flap 250 (shown in FIG. 10) to the inner side of the side panel 240 so that the bottom panel 210, the first side panel 220, the top panel 230, and the second side panel 40 may be opened or set up to form a generally tubular sleeve. The generally tubular sleeve may be closed, for example, by folding and adhering the end flaps 214, 224, 234, 244 at one end of the carton to form a first end panel 330 (FIG. 18), and by folding and adhering the end flaps 212, 222, 232, 242 at the other end of the carton to form a second end panel 340. Containers C2 or other articles, for example, may be loaded into the sleeve at any time before one or both ends of the carton are closed by the end flaps 212, 222, 232, 242, 214, 224, 234, 244. Preferably the containers C are configured in a stacked arrangement (FIG. 12) with the divider 290 positioned between the two layers of containers prior to placing the containers in the carton 250.

Figure 19:
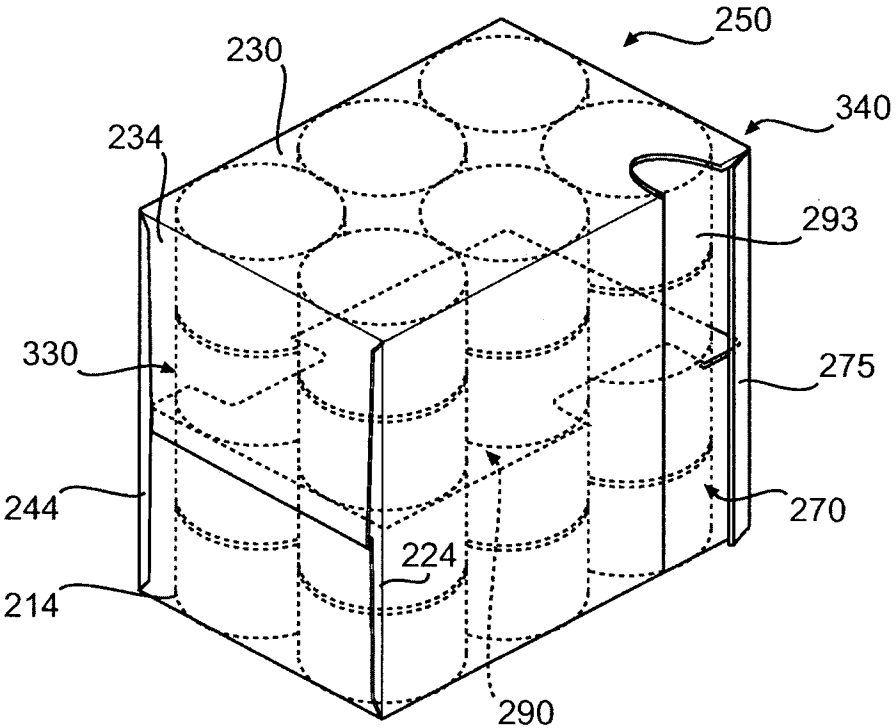
FIG. 19 is a perspective view of the carton and divider of the second embodiment with containers loaded and the first and second ends closed.

FIG. 19 is a perspective view of the carton 250 erected from the blank 208 illustrated in FIG. 10. In the erected carton 250, the end flaps 214, 224, 234, 244 form the first end panel 330 and the end flaps 212, 222, 232, 242 form the second end panel 340. The divider 290 is secured to the carton 250 by interlocking engagement of the first securing flap 302 and second securing flap 308 with the first end panel 330 and the interlocking engagement of the third securing flap 314 with the second end panel 340 of the carton 250. Loading of the carton 250 with containers C2 arranged in a stacked configuration will be discussed below with reference to FIGS. 12-19, and in accordance with one embodiment of the present invention.

Figure 13:
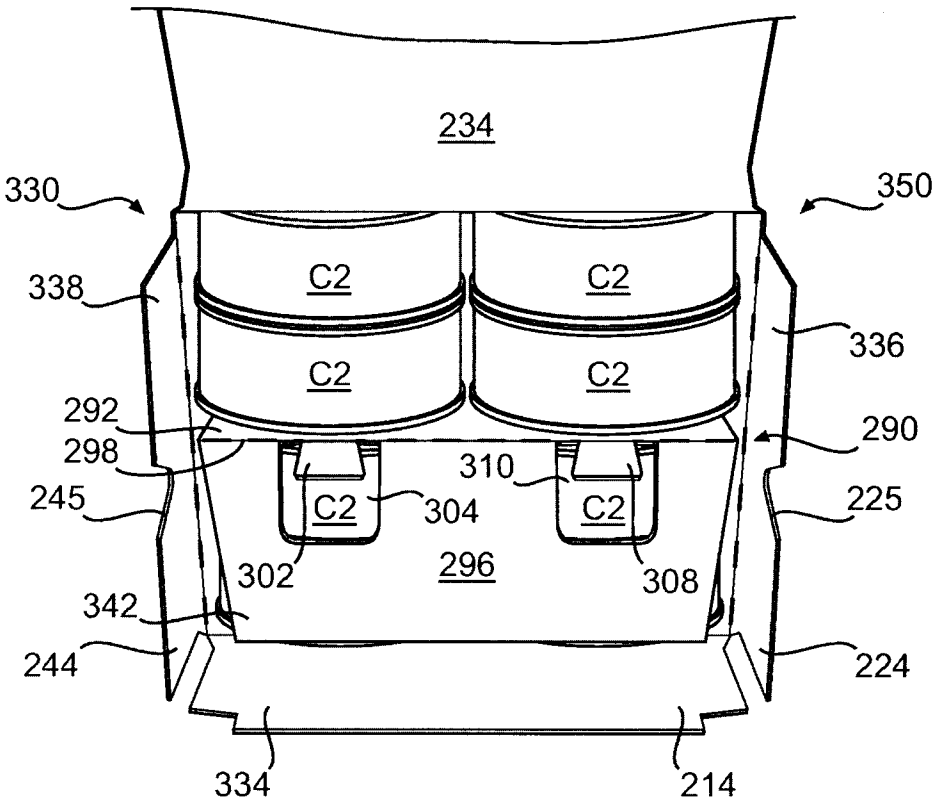
FIG. 13 is a perspective of a first end of the carton of the second embodiment with the containers loaded into the carton.
Figure 15:
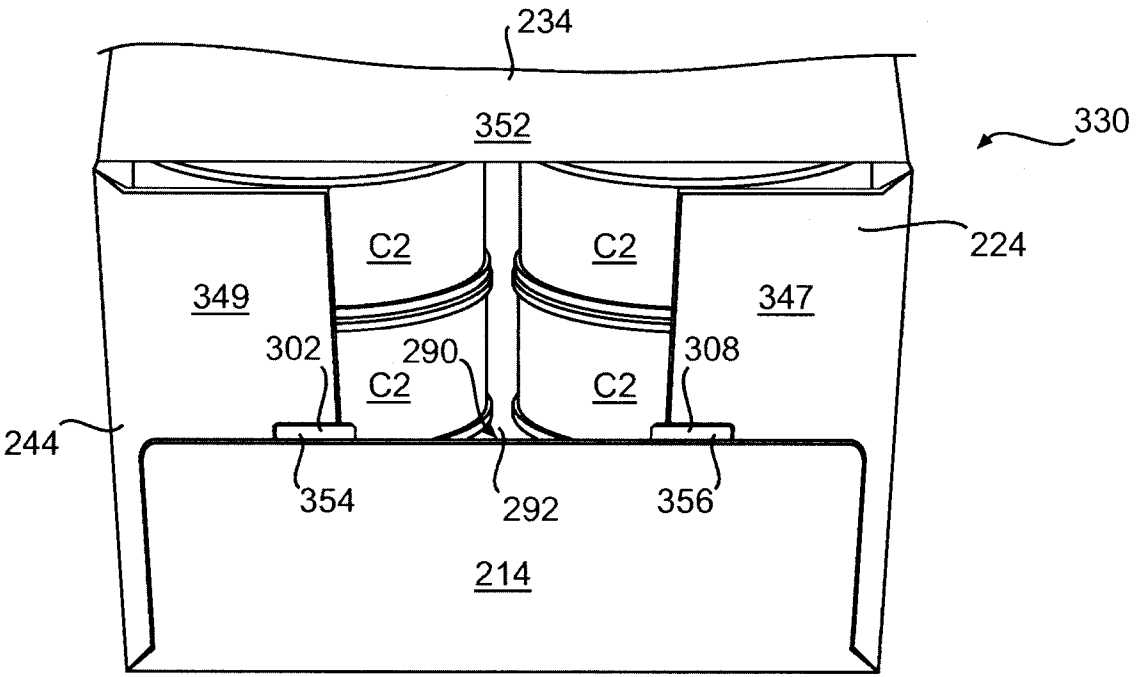
FIG. 15 is a view similar to FIG. 4 but showing a bottom flap of the carton closed.

As shown in FIGS. 12 and 15, the containers C2 may be arranged in a stacked configuration comprising an upper layer and a lower layer of containers C2. In the illustrated embodiment, each layer comprises two rows of three stacked pairs of containers C2. In one embodiment, the divider 290 is positioned between the upper and lower layers of containers C2 such that the divider panel 292 is positioned between the containers C2 and the retention panel 296, the first and second securing flaps 302, 308 extend from one end of the stacked containers, and the third securing flap 314 extends from the other end of the stacked containers. As shown in FIGS. 12 and 13, the retention panel 296 is downwardly folded relative to the divider panel 292 along fold line 298 so that an inner surface of the retention panel 296 is generally adjacent the lower layer of containers C2. The securing tabs 302, 308 are generally parallel with the divider panel 292 extending from the fold line 298 to be generally perpendicular with the retention panel 296. After the containers C2 are arranged in the stacked configuration with the divider 290 positioned between the two layers and the retention panel 296 downwardly folded, the stacked containers are loaded into the carton 250 (FIG. 13).

Figure 14:
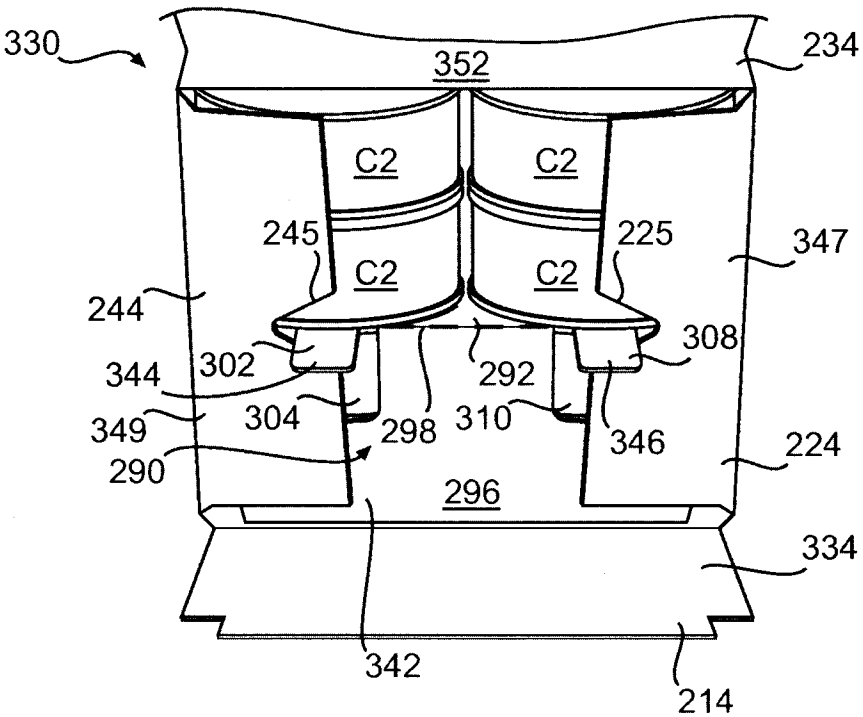
FIG. 14 is a view similar to FIG. 13 but showing side flaps of the carton closed.

After the stacked containers are loaded, the side flaps 224, 244 are moved to the closed position shown in FIG. 14 such that an inner surface 336, 338 (FIG. 13) of each of the flaps is in face-to-face relation with an outer surface 342 of the retention panel 296 and the securing tabs 302, 308 protrude outward from and are received in a respective notch 225, 245 in the side flaps. As shown in FIG. 15, the end flap 214 is raised to the closed position and is positioned such that the inner surface 334 (FIG. 14) of the end flap 214 is in generally face-to-face relation with an outer surface of the securing tabs 302, 308. With the bottom end flap 214 raised to the closed position, the securing flaps 302, 308 are upwardly folded and lodged between the side flaps 224, 244 and the bottom end flap 214 so that the divider 290 is secured to the carton 250. In the closed position of the bottom end flap 214, an inner surface 344, 346 (FIG. 14) of a respective securing tab 302, 308 is in face-to-face relation with an outer surface 347, 349 of each of the side flaps 224, 244. As shown in FIG. 19, the top end flap 234 is folded downward so that an inner surface 352 (FIG. 15) of the top end flap contacts a respective outer surface 354, 356 of the upwardly folded securing tabs 302, 308. The top end flap 234 can be secured to the bottom end flap 214 with an adhesive material such as glue to complete the closure of the first end panel 330.

Figure 16:
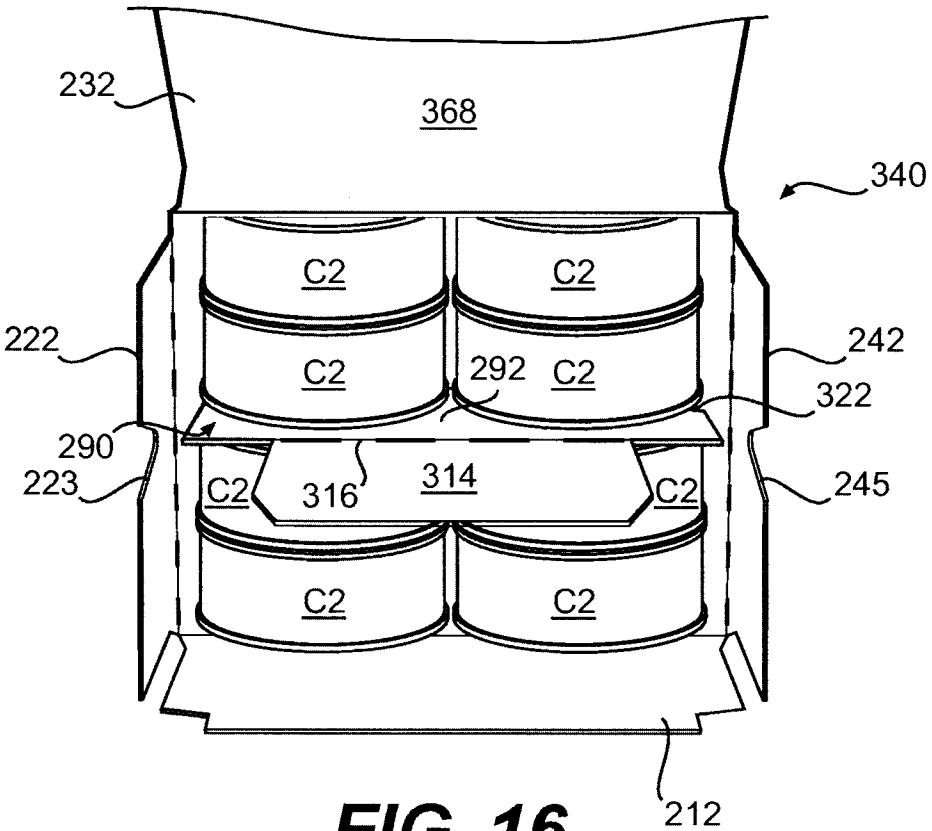
FIG. 16 is a perspective of a second end of the carton with containers loaded into the carton.
Figure 17:
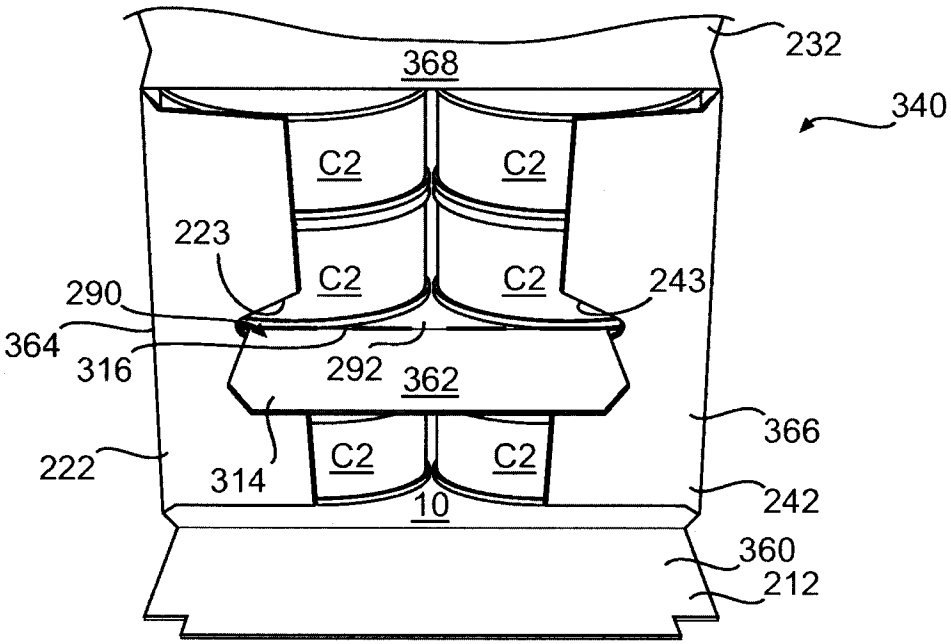
FIG. 17 is a perspective similar to FIG. 16 but showing side flaps of the carton closed.

FIG. 16 shows the second end panel 340 of the carton 150 with the stacked containers C2 loaded in the carton and the third securing flap 308 extending from the divider panel 292 in an unfolded position generally coplanar with the divider panel. As shown in FIG. 17, the second end panel 340 of the carton 350 is closed by first folding the side flaps 222, 242 such that the third securing flap 314 is received in the notches 223, 245 in a respective side flap. As shown in FIGS. 17 and 18, the bottom end flap 212 is folded upward relative to the bottom panel 210 such that the inner surface 360 of the bottom end flap contacts the third securing panel 314 and folds the securing panel upward relative to the divider panel 292 of the divider 290 so that the inner surface 362 of the securing panel is in contact with the outer surfaces 364, 366 of the side flaps 222, 242. In this way, the third securing panel 314 is folded upwardly along fold line 316 such that the securing panel is lodged between the side flaps 222, 242 and the bottom end flap 212 so that the divider 290 is in interlocking engagement at the second end panel 340 of the carton 350. The top end flap 232 is folded downward so that the inner surface 368 (FIG. 16) of the end flap 232 overlays a portion of the outer surface 370 of the securing flap 314 (FIG. 18) and a portion of the outer surface 372 of the bottom end flap 212. To secure the second end panel 340 in the closed position, the top end flap 232 can be secured to the bottom end flap 212 with an adhesive material such as glue.

In the assembled configuration shown in FIG. 19, containers C2 may be withdrawn from the upper level or the lower level of the stacked configuration housed in the carton 250 through the dispenser opening 293. A container or containers C2 adjacent to the dispenser opening 293 can be easily accessed and removed from the carton 250. The divider 290 is secured at both ends 330, 340 of the carton 250 so that when the containers C2 are removed, the divider remains substantially stationary in the carton and the containers remain arranged in a stacked configuration wherein the containers may be easily dispensed from the carton. The securement of the divider 290 in the carton 250 of the second embodiment of the present invention is accomplished by the interlocking engagement of the first and second securing flaps 302, 308 with the side flaps 224, 244 and end flap 214 at the first end panel 330 of the carton, and the interlocking engagement of the third securing flap 314 with the side flaps 222, 242 and end flap 212 at the second end panel 340 of the carton. In this way, the divider 290 is secured to the carton 250 without the use of glue or other adhesive and is positioned to divide an interior space of the carton into an upper chamber and a lower chamber.

For purposes of illustration, the present invention is generally disclosed in the context of paperboard cartons or packages sized and dimensioned to contain cylindrical containers. The cartons illustrated in the drawings are sized to accommodate containers in a two level configuration with multiple columns of containers included in each level, although the present invention is not limited to any specific size or dimension. For example, the embodiment of FIGS. 10-19 is shown to accommodate twenty four containers arranged in a 2×3×4 configuration, however, the present invention would work satisfactorily if sized and shaped to hold other quantities of containers in alternative arrangements, such as 3×4×4, 2×4×4, 2×5×4, 4×6×4, 4×5×4, 3×6×4, 5×6×4, etc. Further the containers C2 may be sized such that one or more than two containers are contained in a stacked configuration in each layer. Further, multiple dividers could be used such that more than two layers of containers could be housed in the carton without departing from the scope of this invention.

Figure 20:
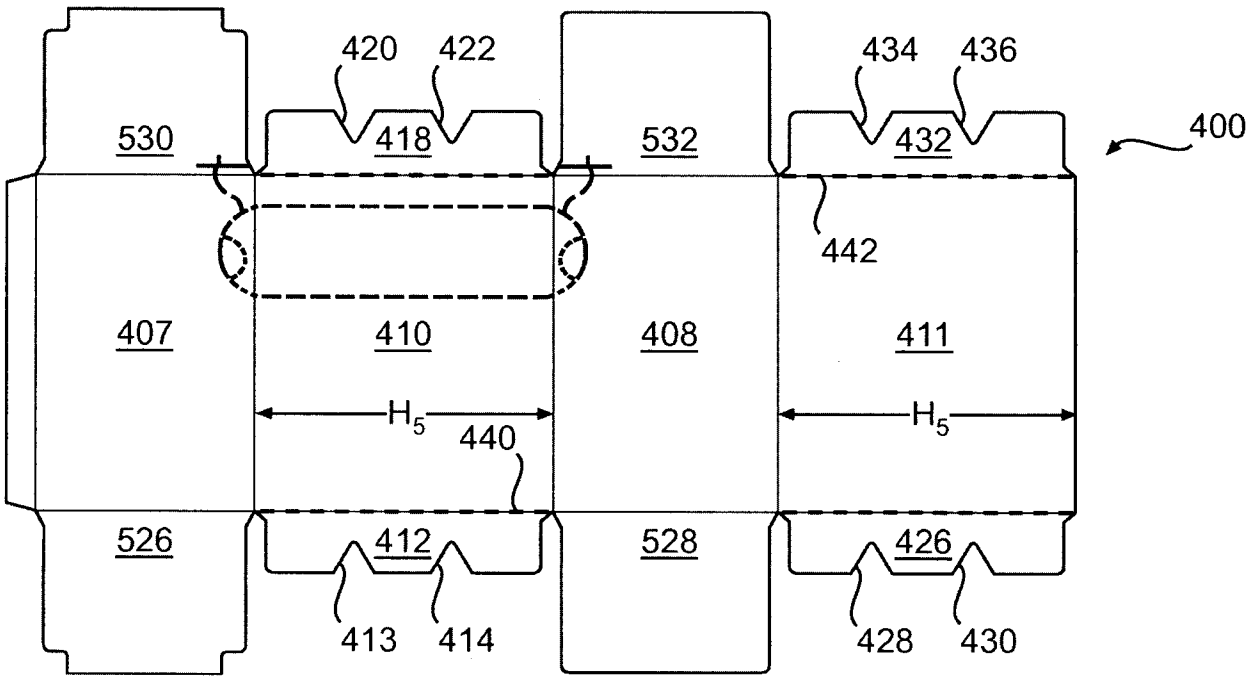
FIG. 20 is a plan view of a blank used to form a carton according to a third embodiment of the invention.
Figure 22:
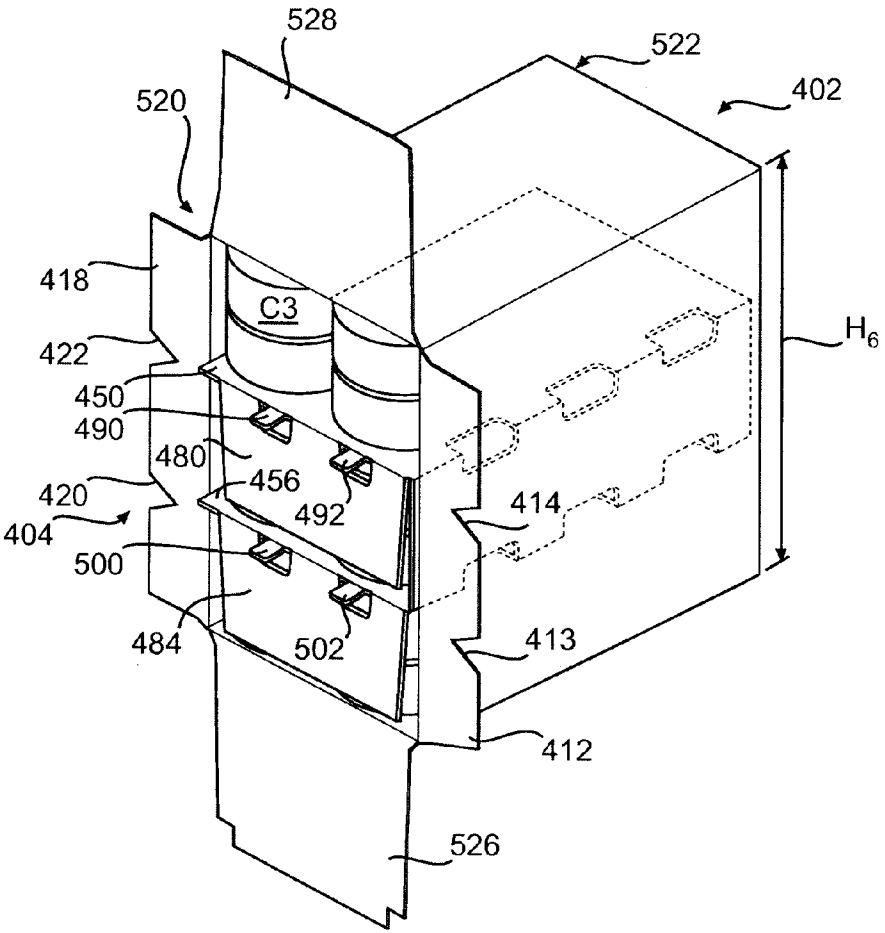
FIG. 22 is a perspective view of the carton and divider of the third embodiment with containers loaded and a first end of the carton open.

FIG. 20 illustrates a carton blank, generally indicated at 400, used to construct a carton, generally indicated 402 (FIG. 22), of a third embodiment of the present invention. The carton 402 can be used to house a plurality of containers C3 (FIG. 22) typically arranged in at least three layers in the carton. The layers of containers C3 are separated by a divider, generally indicated at 404 (FIG. 22) formed from a blank, generally indicated 406.

The blank 400 of the second embodiment includes a bottom panel 407, a top panel 408, first side panel 410, and a second side panel 411. The first side panel 410 is connected to a first side flap 412 having two notches 413, 414 and a second side flap 418 having two notches 420, 422. The second side panel 411 is foldably connected to a first side flap 426 having two notches 428, 430 and a second side flap 432 having two notches 434, 436. The first side flaps 412, 426 are foldably connected to a respective side panel 410, 411 at one end of the blank 402 by longitudinal fold line 440 and the second side flaps 418, 428 are connected to a respective side panel at the other end of the blank by longitudinal fold line 442. In the embodiment of FIG. 20, the first and second side panels 410, 411 have a height H5 that generally corresponds to or slightly exceeds a combined height H6 (FIG. 22) of the layers of containers C3.

Figure 21:
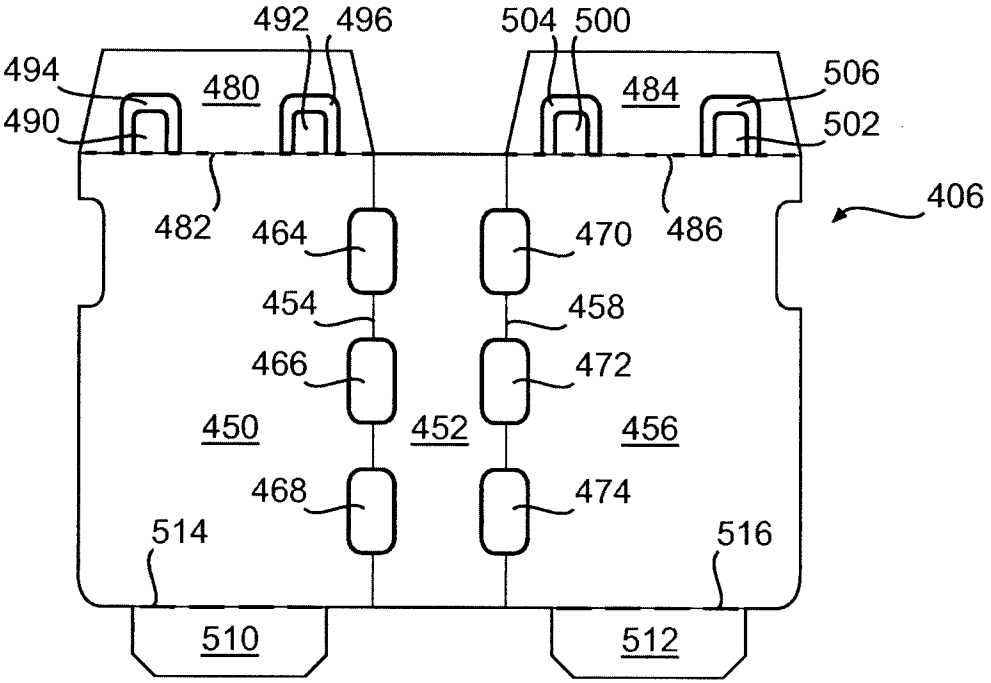
FIG. 21 is a plan view of a blank used to form a divider according to the third embodiment of this invention.

As shown in FIG. 21, the blank 406 comprises a first divider panel 450, foldably attached to a connecting panel 452 at a first transverse fold line 454, and a second divider panel 456 foldably connected to the connecting panel at a second transverse fold line 458. The blank 406 optionally has three cutouts 464, 466, and 468 on the fold line 454 and three cutouts 470, 472, 474 on the fold line 458. The cutouts 464, 466, and 468 assist the folding of the blank 406 along fold line 454 and the cutouts 470, 472, and 474 assist the folding of the blank along fold line 458 when the divider 404 is assembled in the carton 402. It is understood that the cutouts may be otherwise shaped and arranged or may be omitted from the blank 406 without departing from the scope of this invention.

The blank 406 has a first retention panel 480 foldably connected to the first divider panel 450 along a lateral fold line 482 and a second retention panel 484 foldably connected to the second divider panel 456 along a lateral fold line 486. A first securing tab 490 and a second securing tab 492 (broadly "first and second securing flap) are foldably attached to the first divider panel 450 along the fold line 482 and are spaced apart from the retention panel 480 by a respective cutout 494,496. The blank 406 includes a third and fourth securing tab 500, 502 (broadly "third and fourth securing flap) foldably attached to the second divider panel 456 along the fold line 486 that are spaced apart from the retention panel 484 by a respective cutout 504, 506. The cutouts 494, 496, 504, 506 can be in different forms; for example, they can be replaced with slits. The divider panel 450 has a fifth securing flap 510 attached at a fold line 514 at the second end of the blank 406 and the divider panel 456 has a sixth securing flap 512 attached at a fold line 516 at the second end of the blank.

As with the previous embodiments, the securing tabs 490, 492, 500, 502 secure the divider 404 to a first closed end 520 (FIG. 22) of the carton 402 and the fifth and sixth securing flaps 510, 512 secure the divider 404 to a second closed end 522 of the carton. Preferably the containers C3 are configured in a stacked arrangement (FIG. 22) of three layers of containers with the first divider panel 450 positioned between the bottom and middle layers of containers and the second divider panel 456 position between the middle and upper layers of containers prior to placing the containers in the carton 402. When the stacked containers C3 are placed in the carton 402, the connecting panel 452 is generally adjacent the side panel 410 of the carton. The securing tabs 494, 496, 500, 502 and securing flaps 510, 512 of the divider 404 are attached to the carton 402 in a similar manner as described above for the divider 290. In the illustrated embodiment of FIG. 22, the securing tabs 494, 496, 500, 502 are received in a respective notch 413, 414, 428, 430 when the side flaps 412, 416 are closed to form the closed end 525. The securing tabs 500, 502 are upwardly folded with respect to fold lines 482 and 486 when the bottom end flap 526 is upwardly folded to close the end 520 of the carton 402. The securing tabs 490, 492 are downwardly folded with respect to fold line 486 when the top end flap 528 is downwardly folded to close the end 520 of the carton 402. When the side flaps 418, 432 are closed, the securing flaps 510, 512 of the divider 404 are received in respective notches 420, 422, 434, 436 at the second end 522 of the carton 402. The first securing flap 510 is folded upward with respect to the fold line 514 when the bottom end flap 530 is upwardly folded to close the end 522 of the carton 402. The second securing flap 512 is folded downward with respect to the fold line 516 when the top end flap 532 is downwardly folded to complete the closure of the end 522 of the carton 402. In this way the divider 404 is secured to the carton 402 at the first end 520 by the interlocking engagement of the securing tabs 490, 492, 500, 502 with the side flaps 412, 426 and top and bottom end flaps 526, 528 and at the second end 522 the interlocking engagement of the securing flaps 510, 512 with the side flap 418, 432 and top and bottom end flap 530, 532.

The divider 404 of the third embodiment stays substantially in place when containers C3 are removed from any of the three layers in the carton 402. Accordingly, removal of containers C3 from one side of a respective layer does not compromise the stability of the remaining containers of that layer. Accordingly, the containers C3 in the carton 402 stay substantially organized until all the containers have been removed from the carton.

The present invention can be used in cartons that include various features, including additional opening features that provide easy access to the articles, and tilt features that position the articles at the front or rear end of the carton. In accordance with an alternative embodiment, a divider panel is interlockingly engaged only to one of the closed ends of a carton.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described above. The blanks can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. Blanks for forming a carton and a divider, the blanks comprising:

a first blank for forming the carton, the first blank comprising a plurality of panels comprising a bottom panel, a top panel, a first side panel, a second side panel, and at least two end flaps are respectively foldably attached to respective panels of the plurality of panels, the end flaps are for being at least partially overlapped to form a closed end of the carton formed from the first blank; and a second blank for forming the divider for dividing an interior space of the carton, the second blank comprising a divider panel, a retention panel foldably attached to the divider panel, and a securing flap foldably attached to the divider panel and adapted for interlocking engagement with the at least two end flaps at the closed end of the carton formed from the first blank, the securing flap and the retention panel are foldably connected to the divider panel at a fold line, the retention panel comprises an outer periphery and a cutout that is spaced apart from the outer periphery of the retention panel, and the securing flap is spaced apart from the retention panel by the cutout.

2. Blanks for forming a carton and a divider, the blanks comprising:

a first blank for forming the carton, the first blank comprising a plurality of panels comprising a bottom panel, a top panel, a first side panel, a second side panel, and at least two end flaps are respectively foldably attached to respective panels of the plurality of panels, the end flaps are for being at least partially overlapped to form a closed end of the carton formed from the first blank; and a second blank for forming the divider for dividing an interior space of the carton, the second blank comprising a divider panel, a retention panel foldably attached to the divider panel, and a first securing flap foldably attached to the divider panel and adapted for interlocking engagement with the at least two end flaps at the closed end of the carton formed from the first blank, the first securing flap and the retention panel are foldably connected to the divider panel at a fold line;

wherein the second blank further comprises a second securing flap generally adjacent the first securing flap and foldably connected to the divider panel at the fold line.

3. The blanks of claim 2 wherein the second blank has a first longitudinal end and a second longitudinal end and the first and second securing flaps are located at the first longitudinal end of the second blank, the second blank further comprising a third securing flap at the second longitudinal end of the blank foldably connected to the divider panel.

4. The blanks of claim 2 wherein the divider panel is a first divider panel, the retention panel is a first retention panel, and the securing flap is a first securing flap and the second blank further comprises a second divider panel, a second retention panel foldably connected to the second divider panel, a second securing flap foldably connected to the second divider panel, and a connecting panel foldably connected to the first divider panel and second divider panel.

5. A blank for forming a divider for separating layers of articles in a carton, the blank comprising:

a divider panel;

a retention panel foldably connected to the divider panel at a fold line; and a securing flap foldably connected to the divider panel at the fold line, the securing flap being independently moveable relative to the divider panel and the retention panel, wherein the retention panel comprises an outer periphery and a cutout that is spaced apart from the outer periphery of the retention panel, and the securing flap is spaced apart from the retention panel by the cutout.

6. The blank of claim 5 wherein the divider panel has at least one notch in a longitudinal edge of the divider panel.

7. The blank of claim 5 wherein the securing flap is a first securing flap and the blank further comprises a second securing flap generally adjacent the first securing flap and foldably connected to the divider panel at the fold line.

8. The blank of claim 7 wherein the blank has a first longitudinal end and a second longitudinal end and the first and second securing flaps are located at the first longitudinal end of the blank, the blank further comprising a third securing flap at the second longitudinal end of the blank, the third securing flap being foldably connected to the divider panel.

9. The blank of claim 7 wherein the cutout is a first cutout, the retention panel comprises a second cutout that is spaced apart from the outer periphery of the retention panel, and the second securing flap is spaced apart from the retention panel by the second cutout.

10. A blank for forming a divider for separating layers of articles in a carton, the blank comprising:

a first divider panel;

a first retention panel foldably connected to the first divider panel at a fold line; and a first securing flap foldably connected to the first divider panel at the fold line, the first securing flap being independently moveable relative to the first divider panel and the retention panel;

a second securing flap generally adjacent the first securing flap and foldably connected to the first divider panel at the fold line; and a second divider panel, a second retention panel foldably connected to the second divider panel, a third securing flap foldably connected to the second divider panel, and a connecting panel foldably connected to the first divider panel and second divider panel.

11. A method of assembling a carton from a first blank and a second blank, the method comprising:

obtaining a first blank comprising a plurality of panels comprising a bottom panel, a top panel, a first side panel, a second side panel, and at least two end flaps respectively foldably attached to respective panels of the plurality of panels;

obtaining a second blank comprising a divider panel, a retention panel foldably attached to the divider panel, and a securing flap foldably attached to the divider panel, the securing flap and the retention panel are foldably connected to the divider panel at a fold line, the retention panel comprises an outer periphery and a cutout that is spaced apart from the outer periphery of the retention panel, and the securing flap is spaced apart from the retention panel by the cutout;

forming a carton from the first blank, the carton having an interior space at least partially defined by the plurality of panels;

positioning a plurality of articles to be arranged in at least two layers;

forming a divider from the second blank and positioning the divider panel between the at least two layers;

at least partially closing a first end of the carton by overlapping the at least two end flaps;

securing the securing flap at a first end of the carton by folding the securing flap and lodging the securing flap between the at least two end flaps.

12. The method of claim 11 wherein the securing flap is a first securing flap and the second blank further comprises a second securing flap generally adjacent the first securing flap and foldably connected to the divider panel at the fold line, the securing the securing flap comprises folding the first securing flap and the second securing flap and lodging the first and second securing flaps between the at least two end flaps.

13. The method of claim 11 wherein the second blank has a first longitudinal end and a second longitudinal end, the securing flap is a first securing flap and the second blank further comprises a second securing flap, the first and second securing flaps are located at the first longitudinal end of the second blank, the second blank further comprises a third securing flap at the second longitudinal end of the blank foldably connected to the divider panel, the at least two end flaps comprise first end flaps for closing the first end of the carton and second end flaps for closing a second end of the carton, the method further comprises securing the third securing flap at the second end of the carton by folding the third securing flap and lodging the third securing flap between the second end flaps at the second end of the carton.

14. The method of claim 11 wherein the divider panel is a first divider panel, the retention panel is a first retention panel, and the securing flap is a first securing flap and the second blank further comprises a second divider panel, a second retention panel foldably connected to the second divider panel, a second securing flap foldably connected to the second divider panel, and a connecting panel foldably connected to the first divider panel and second divider panel, the positioning the plurality of articles comprises arranging the articles in at least three layers, the forming the divider comprises placing the first divider panel and the second divider panel between respective layers of the at least three layers.

15. The method of claim 11 wherein closing the end comprises applying adhesive to at least one of the at least two end flaps.

16. The method of claim 11 wherein securing the securing flap comprises placing the securing flap in interlocking engagement with the at least two end flaps without the application of adhesive to the securing flap.

* * * * *